US009044935B2

(12) United States Patent
Kudo et al.

(10) Patent No.: US 9,044,935 B2
(45) Date of Patent: Jun. 2, 2015

(54) ELEMENT SUBSTRATE, PRINTHEAD, AND PRINTING APPARATUS

(71) Applicant: CANON KABUSHIKI KAISHA, Tokyo (JP)

(72) Inventors: Tomoko Kudo, Kawasaki (JP); Ryo Kasai, Tokyo (JP); Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/300,712

(22) Filed: Jun. 10, 2014

(65) Prior Publication Data

US 2015/0002566 A1 Jan. 1, 2015

(30) Foreign Application Priority Data

Jul. 1, 2013 (JP) ..... 2013-138440

(51) Int. Cl.
*B41J 2/165* (2006.01)
*B41J 2/045* (2006.01)

(52) U.S. Cl.
CPC ..... *B41J 2/04541* (2013.01); *B41J 2/04521* (2013.01); *B41J 2/04523* (2013.01); *B41J 2/0455* (2013.01); *B41J 2/04563* (2013.01); *B41J 2/0458* (2013.01); *B41J 2/04588* (2013.01); *B41J 2/04598* (2013.01)

(58) Field of Classification Search
None
See application file for complete search history.

(56) References Cited

U.S. PATENT DOCUMENTS

| | | | |
|---|---|---|---|
| 6,331,039 | B1 | 12/2001 | Iwasaki et al. |
| 7,806,495 | B2 | 10/2010 | Kasai |
| 2003/0090533 | A1 | 5/2003 | Imanaka et al. |
| 2008/0278530 | A1 | 11/2008 | Tanaka et al. |
| 2013/0314464 | A1 | 11/2013 | Kudo et al. |

FOREIGN PATENT DOCUMENTS

| | | | |
|---|---|---|---|
| EP | 0694395 | A2 | 1/1996 |
| JP | 10-119273 | A | 5/1998 |
| JP | 2007-022069 | A | 2/2007 |
| JP | 2008-302691 | A | 12/2008 |

OTHER PUBLICATIONS

European Search Report issued in corresponding EP application No. 14002260.9 dated on Oct. 6, 2014—4 pages.

*Primary Examiner* — Alejandro Valencia
(74) *Attorney, Agent, or Firm* — Fitzpatrick, Cella, Harper & Scinto

(57) ABSTRACT

An embodiment of this invention relates to an element substrate that implements size reduction of the element substrate and simplification of the arrangement as well as a highly-reliable print operation, a printhead using the same, and a printing apparatus including the printhead. In the element substrate according to this embodiment, the slope of a ramp wave is changed to generate a plurality of pulses using one reference voltage. The slope of the ramp wave can be changed by changing the mirror ratio or the capacitance of a comparator as well as by changing the resistance of a DAC.

13 Claims, 19 Drawing Sheets

FIG. 18

| | RESISTANCE RATIO | MIRROR RATIO | CAPACITANCE RATIO |
|---|---|---|---|
| Vref | 3 | 3 | NOT SET |
| PWM1 | 2.1 | 2.1 | 1.17 |
| PWM2 | 1.6 | 1.6 | 0.57 |
| PWM3 | 1.2 | 1.2 | 0.33 |
| PWM4 | 0.9 | 0.9 | 0.21 |

| ENVIRONMENTAL TEMPERATURE (envT) | DRIVING PULSE | PREPULSE [μs] | INTERVAL TIME [μs] | MAIN PULSE [μs] |
|---|---|---|---|---|
| envT<18°C | PWM1 | 0.60 | 1.82 | 0.86 |
| 18°C≤envT<23°C | PWM2 | 0.50 | 1.86 | 0.92 |
| 23°C≤envT<28°C | PWM3 | 0.40 | 1.90 | 0.98 |
| 28°C≤envT | PWM4 | 0.20 | 1.94 | 1.04 |

ELEMENT SUBSTRATE, PRINTHEAD, AND PRINTING APPARATUS

BACKGROUND OF THE INVENTION

1. Field of the Invention

The present invention relates to an element substrate, a printhead, and a printing apparatus and, particularly, to a full-line printhead having an element substrate integrated with it, which performs printing in accordance with, for example, an inkjet method and a printing apparatus that performs printing using the same. More specifically, the present invention relates to a printhead including an element substrate, in which a plurality of print elements and driving circuits configured to drive the print elements are provided on the single element substrate, and a printing apparatus.

2. Description of the Related Art

For example, as information output apparatuses such as a word processor, a personal computer, and a facsimile apparatus, in general, inkjet printing apparatuses (to be referred to as printing apparatuses hereinafter) for printing any desired information such as characters and images on a sheet-like printing medium such as a paper sheet or a film are widely used.

Electrothermal transducers (heaters) of a printhead included in a printing apparatus and driving circuits thereof are generally formed on a single substrate using the semiconductor process technology as described in, for example, Japanese Patent Laid-Open No. 2007-022069. As one configuration, there is proposed a printhead having an element substrate integrated with it, in which an ink supply port is located near the center of the substrate, and heaters facing each other are located at positions sandwiching the ink supply port.

In addition, for example, Japanese Patent Laid-Open No. 10-119273 discloses a method of correcting a fluctuation in the discharge characteristics of a printhead with respect to the temperature.

FIG. 22 is a timing chart showing the structure of a double-pulse.

As shown in FIG. 22, in a double-pulse, a preheat signal (prepulse) to a printhead is generated before the discharge timing of a main pulse, and an interval time is generated between the main pulse and the prepulse. In the times of these pulses, temperature correction of the printhead, correction by a fluctuation in the sensitivity of a temperature sensor, correction by a fluctuation in the temperature-discharge characteristics of each nozzle, and the like are reflected. Note that the pulse width of the prepulse, the interval time, and the pulse width of the main pulse are represented by T1, T2, and T3, respectively, and the same reference symbols are used throughout the following explanation.

For example, Japanese Patent Laid-Open No. 2008-302691 discloses an arrangement that adjusts the respective times of a double-pulse in accordance with the environmental temperature.

FIGS. 23A and 23B are views showing an example in which the respective times of a double-pulse are adjusted in accordance with the environmental temperature based on the arrangement disclosed in Japanese Patent Laid-Open No. 2008-302691.

According to FIG. 23A, for example, when the environmental temperature envT is 28° C. or more, PWM4 is selected as a driving pulse. In this case, as shown in FIG. 23B, the start time of the pulse delays as compared to the remaining three pulses PWM1 to PWM3. However, the total time of the double-pulse is constant in principle. In particular, the fall of the main pulse is constant to align the discharge timing.

When the arrangement of the above-described related art is employed, the pulse width of an HE signal can desirably be set. However, in a case where a heater is driven a plurality of times at the same heating period, that is, an HE signal pulse is given a plurality of times, as shown in FIG. 22, reference voltage setting data corresponding to the plurality of pulse times is necessary, and the amount of data increases. As a result, a countermeasure need to be taken by, for example, increasing the speed of data transfer from the main body of the printing apparatus to the printhead or dividing data. This poses problems such as a decrease in reliability of a print operation and an increase in the number of terminals on the element substrate of the printhead. Additionally, the circuit scale increases because a plurality of memories are needed to set a plurality of pulse width data.

SUMMARY OF THE INVENTION

Accordingly, the present invention is conceived as a response to the above-described disadvantages of the conventional art.

For example, an element substrate, a printhead using the same, and a printing apparatus including the printhead according to this invention are capable of implementing size reduction of the element substrate and simplification of the arrangement as well as a highly-reliable print operation.

According to one aspect of the present invention, there is provided an element substrate comprising: a plurality of print elements; a plurality of drive elements provided in correspondence with the plurality of print elements and configured to drive the plurality of print elements; and a driving circuit configured to generate a double-pulse upon receiving a single reference voltage and two ramp waves and apply the double-pulse to the plurality of drive elements and drive the plurality of drive elements. The driving circuit includes: a generation circuit configured to generate the single reference voltage and the two ramp waves; and a comparison circuit configured to compare the single reference voltage with the two ramp waves, and the driving circuit generates a plurality of double-pulses having different pulse widths from a result of comparison of the comparison circuit, using ramp waves having different slopes.

According to another aspect of the present invention, there is provided a printhead using an element substrate having the above-described arrangement and, more particularly, a full-line inkjet printhead that prints by discharging ink in accordance with an inkjet method.

According to still another aspect of the present invention, there is provided a printing apparatus for printing using the full-line printhead.

The invention is particularly advantageous since a plurality of double-pulses can be generated from one reference voltage. This obviates the necessity of using many data for generation of a plurality of double-pulses and can thus eliminate the arrangement necessary for transfer and control of many data. This contributes to size reduction of the element substrate, simplification of the element circuit, and highly-reliable print operation).

Further features of the present invention will become apparent from the following description of exemplary embodiments (with reference to the attached drawings).

BRIEF DESCRIPTION OF THE DRAWINGS

FIG. 18 is a table showing values that are necessary in a case where three different methods are used to obtain different driving pulses PWM1 to PWM4 by changing the slope of a ramp wave for the main pulse using a prepulse as a reference.

DESCRIPTION OF THE EMBODIMENTS

Figure 1:
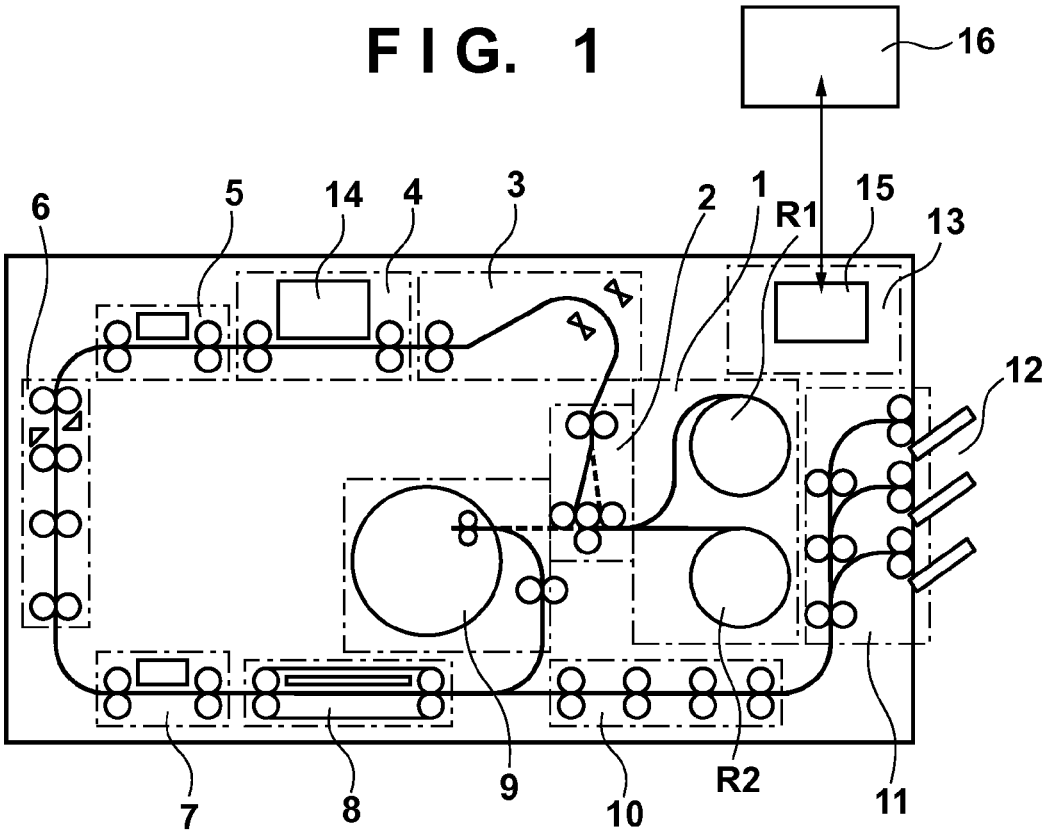
FIG. 1 is a schematic side sectional view showing the internal arrangement of an inkjet printing apparatus according to an exemplary embodiment of the present invention.

Exemplary embodiments of the present invention will now be described in detail in accordance with the accompanying drawings. Note that the same reference numerals denote already explained parts, and a repetitive description thereof will be omitted.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" generically means an ink orifice or a liquid channel communicating with it, and an element for generating energy used to discharge ink, unless otherwise specified.

An element substrate (head substrate) for a printhead to be used below indicates not a mere base made of silicon semiconductor but a component provided with elements, wirings, and the like.

"On the substrate" not only simply indicates above the element substrate but also indicates the surface of the element substrate and the inner side of the element substrate near the surface. In the present invention, "built-in" is a term not indicating simply arranging separate elements on the substrate surface as separate members but indicating integrally forming and manufacturing the respective elements on the element substrate in, for example, a semiconductor circuit manufacturing process.

An embodiment of an inkjet printing apparatus will be described next. This printing apparatus is a high-speed line printer that uses a continuous sheet (print medium) wound into a roll and supports both single-sided printing and double-sided printing. The printing apparatus is suitable for, for example, a mass print field in a print laboratory or the like.

FIG. 1 is a side sectional view showing the schematic internal arrangement of an inkjet printing apparatus (to be referred to as a printing apparatus hereinafter) according to an exemplary embodiment of the present invention. The interior of the apparatus can roughly be divided into a sheet supply unit 1, a decurling unit 2, a skew adjustment unit 3, a print unit 4, a cleaning unit (not shown), an inspection unit 5, a cutter unit 6, an information printing unit 7, a drying unit 8, a sheet winding unit 9, a discharge conveyance unit 10, a sorter unit 11, a discharge tray 12, a control unit 13, and the like. A sheet is conveyed by a conveyance mechanism including roller pairs and a belt along a sheet conveyance path indicated by the solid line in FIG. 1 and undergoes processing of each unit.

The sheet supply unit 1 stores and supplies a continuous sheet wound into a roll. The sheet supply unit 1 can store two rolls R1 and R2, and is configured to selectively draw and supply a sheet. Note that the number of storable rolls is not limited to two, and one or three or more rolls may be stored. The decurling unit 2 reduces the curl (warp) of the sheet supplied from the sheet supply unit 1. The decurling unit 2 bends and strokes the sheet so as to give a warp in an opposite direction to the curl using two pinch rollers with respect to one driving roller, thereby reducing the curl. The skew adjustment unit 3 adjusts the skew (tilt with respect to the original traveling direction) of the sheet that has passed through the decurling unit 2. A sheet end on a reference side is pressed against a guide member, thereby adjusting the skew of the sheet.

The print unit 4 forms an image on the conveyed sheet by a printhead unit 14. The print unit 4 also includes a plurality of conveyance rollers configured to convey the sheet. The printhead unit 14 includes a full-line printhead (inkjet printhead) in which an inkjet nozzle array is formed within a range covering the maximum width of sheets assumed to be used. In the printhead unit 14, a plurality of printheads are arranged parallelly along the sheet conveyance direction. In this embodiment, the printhead unit 14 includes four printheads corresponding to four colors of K (black), C (cyan), M (magenta), and Y (yellow). The printheads are arranged in the order of K, C, M, and Y from the upstream side of sheet conveyance. Note that the number of ink colors and the number of printheads are not limited to four. As the inkjet method, a method using heating elements, a method using piezoelectric elements, a method using electrostatic elements, a method using MEMS elements, or the like can be employed. The respective color inks are supplied from ink tanks to the printhead unit 14 via ink tubes.

The inspection unit 5 optically reads an inspection pattern or image printed on the sheet by the print unit 4, and inspects the states of nozzles of the printheads, the sheet conveyance state, the image position, and the like. The inspection unit 5 includes a scanner unit that actually reads an image and generates image data, and an image analysis unit that analyzes the read image and returns the analysis result to the print unit 4. The inspection unit 5 includes a CCD line sensor which is arranged in a direction perpendicular to the sheet conveyance direction.

Figure 2:
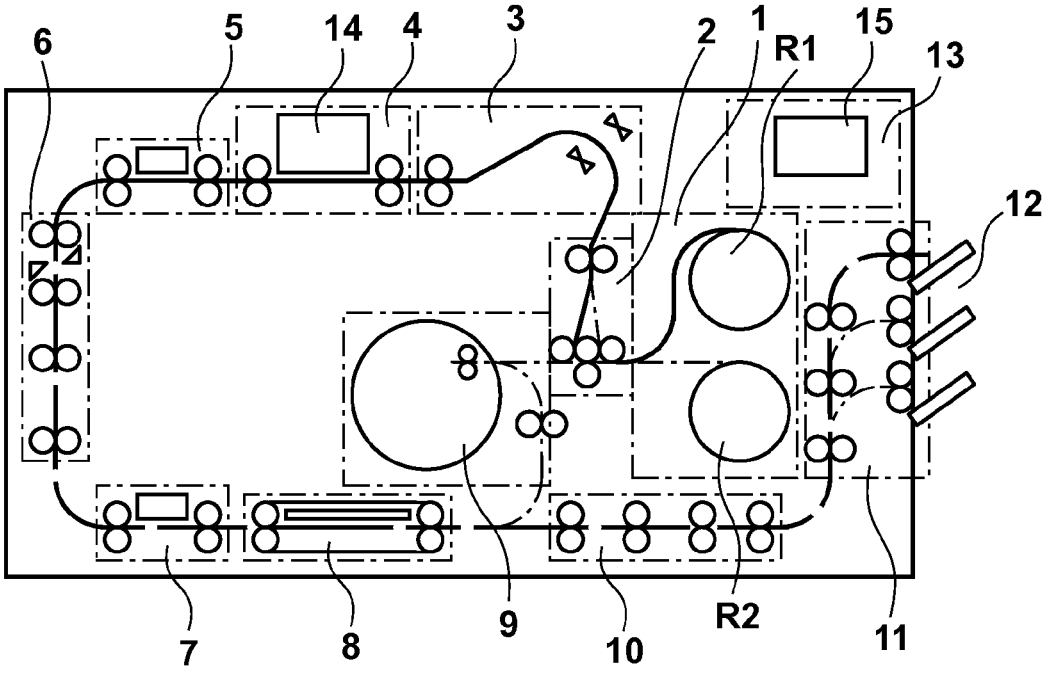
FIG. 2 is a view for explaining the single-sided printing operation of the printing apparatus shown in FIG. 1.
Figure 3:
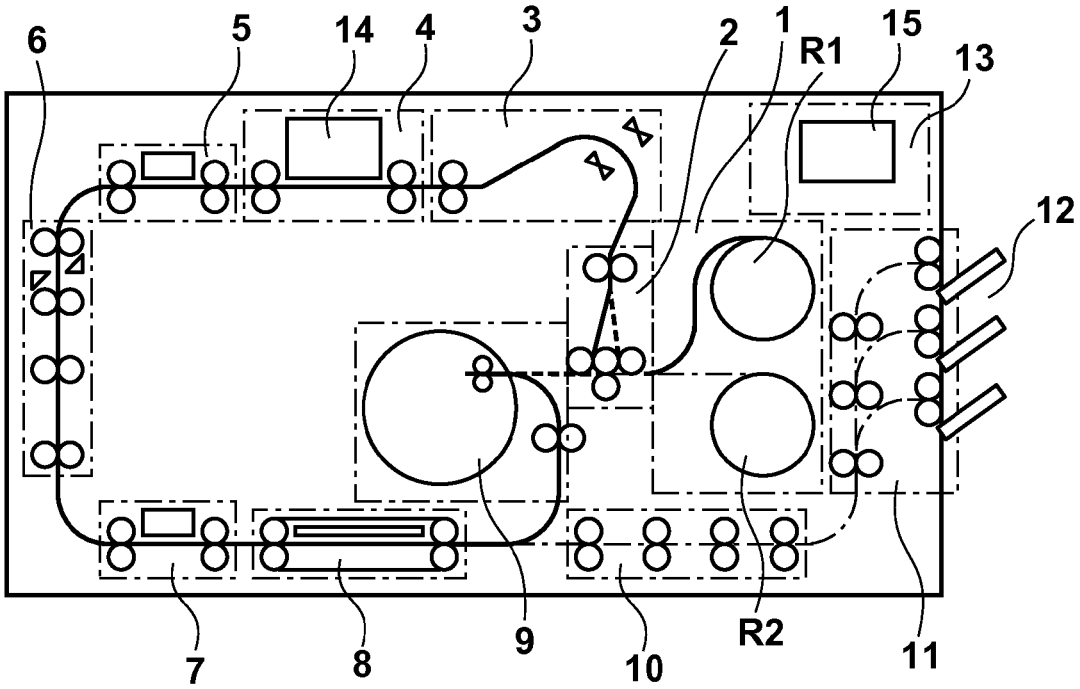
FIG. 3 is a view for explaining the double-sided printing operation of the printing apparatus shown in FIG. 1.

Note that the printing apparatus shown in FIG. 1 supports both single-sided printing and double-sided printing, as described above. FIGS. 2 and 3 are views for explaining the single-sided printing operation and double-sided printing operation of the printing apparatus shown in FIG. 1, respectively.

Figure 4:
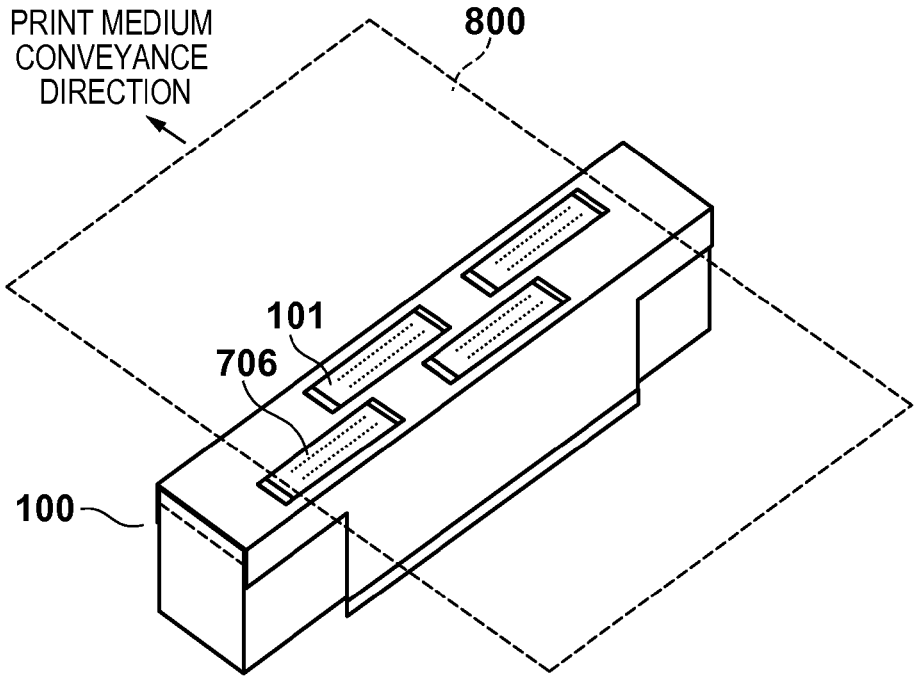
FIG. 4 is a perspective view of a full-line printhead.

FIG. 4 is a view showing the relationship between a full-line printhead 100 included in the printhead unit 14 and the conveyance direction of a print medium 800.

When performing a printing operation, the full-line printhead 100 is fixed on the printing apparatus, the print medium 800 is conveyed, and the inks are discharged from a plurality of orifices 706 provided in element substrates 101, thereby forming an image on the print medium 800.

As is apparent from FIG. 4, in this example, the full-line printhead 100 is formed by integrating four element substrates 101.

Figure 5:
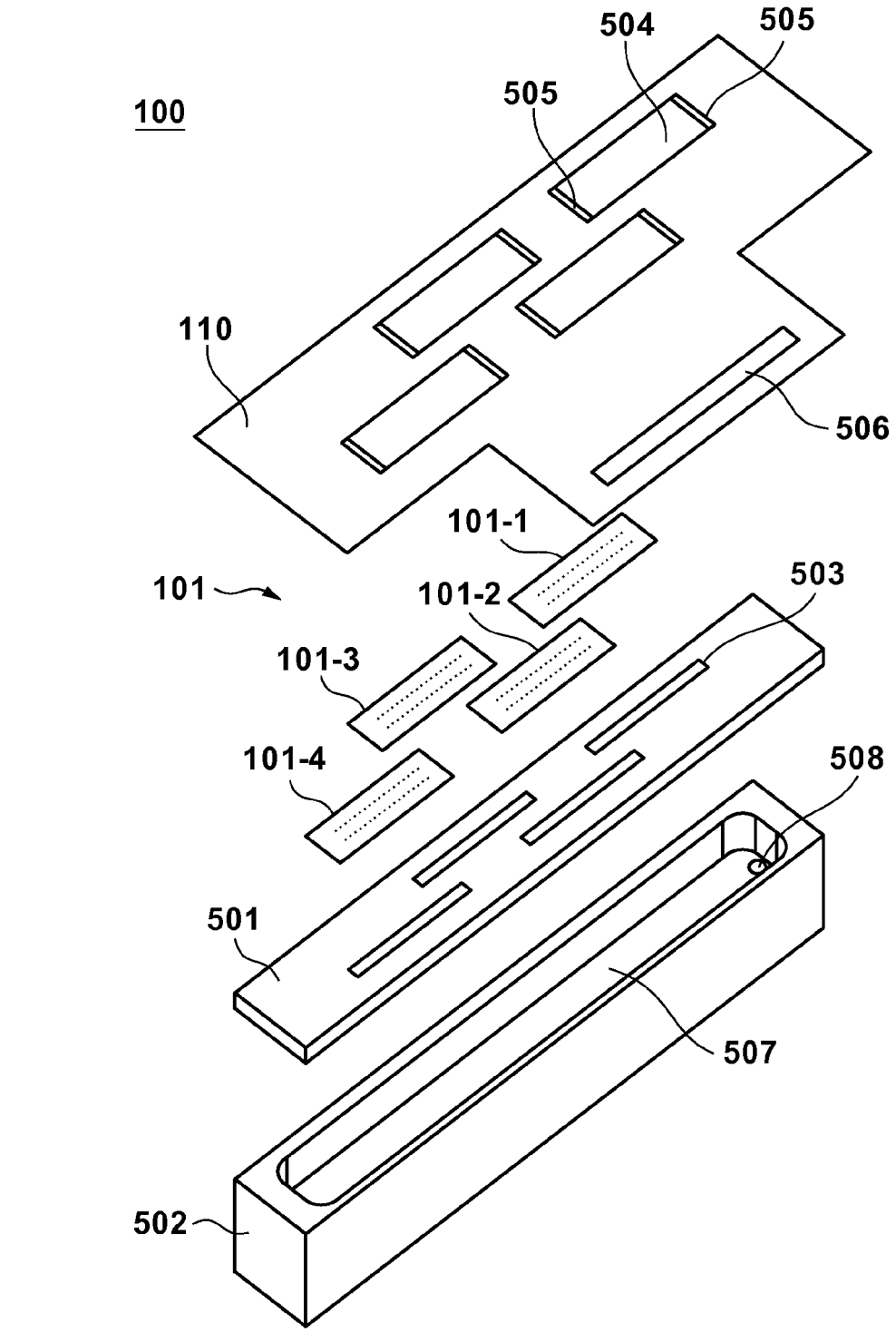
FIG. 5 is an exploded perspective view of the full-line printhead.

FIG. 5 is an exploded perspective view of the full-line printhead.

The full-line printhead 100 includes four element substrates 101-1, 101-2, 101-3, and 101-4, a support member 501, a printed board 110, and an ink supply member 502. As shown in FIG. 5, the four element substrates are arranged zigzag in the full-line printhead 100. Note that a printhead having a larger print width can be formed by increasing the number of element substrates 101 included. When explaining the four element substrates without individually specifying them, they will simply be referred to as element substrates 101.

As is apparent from FIG. 5, the printed board 110 basically has a rectangular shape, and the element substrates 101 have a rectangular shape. The plurality of orifices 706 are arrayed in the longitudinal direction of the element substrates 101. The element substrates 101 are arranged such that their longitudinal direction, that is, the arrayed direction of the plurality of orifices coincides with the longitudinal direction of the printed board 110.

Several embodiments will be described next concerning an element substrate integrated with a full-line printhead included in a printing apparatus having the above-described arrangement.

First Embodiment

A following HE signal is taken into consideration as a prerequisite to an explanation of this embodiment.

Figure 20:
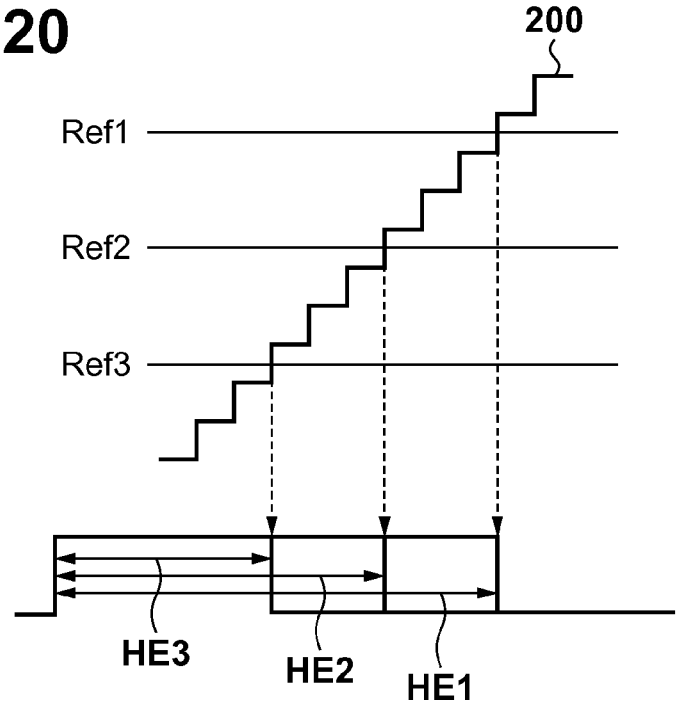
FIG. 20 is a timing chart for explaining a method of modulating the pulse width by comparing a ramp wave and a reference voltage Ref.

In FIG. 20, comparison between a ramp wave and a reference voltage Ref is applied to modulation of a heat enable (HE) signal that is a signal for determining a period to drive a heater in an inkjet printhead (to be referred to as a printhead hereinafter).

Referring to FIG. 20, a ramp wave 200 has such a waveform that raises the voltage in proportion to time (along with an elapse of time). Ref1 to Ref3 are reference voltages Ref that can desirably be set. The ramp wave 200 is compared with each of the reference voltages Ref1 to Ref3, and the pulse is set to fall at a timing where the voltages equal. This makes it possible to change the pulse width by the set reference voltage. For example, in a case where the reference voltage Ref1 is set, the pulse width of the HE signal is HE1. The pulse width is HE2 for the reference voltage Ref2, and HE3 for the reference voltage Ref3. In this way, the pulse width can desirably be set by comparing the ramp wave and the reference voltage.

Figure 21:
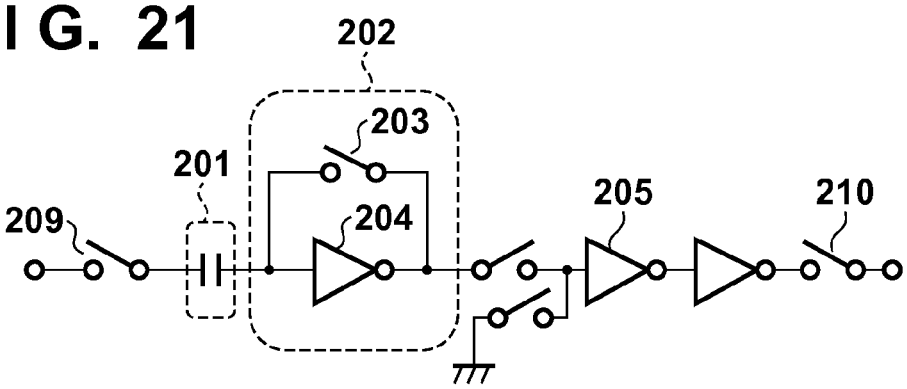
FIG. 21 is a circuit diagram showing the arrangement of a comparator that compares the reference voltage and the ramp wave.

FIG. 21 is a circuit diagram showing the arrangement of a comparator that compares the reference voltage and the ramp wave.

This comparator includes a memory formed from a capacitor 201, a comparison portion 202 formed from a switch 203 and an inverter 204, and a buffer 205 configured to output a waveform. This comparator stores the reference voltage Ref in the memory, and then compares it with an input ramp wave. Note that switches 209 and 210 are provided in the input and output portions of the comparator, respectively.

Figure 22:
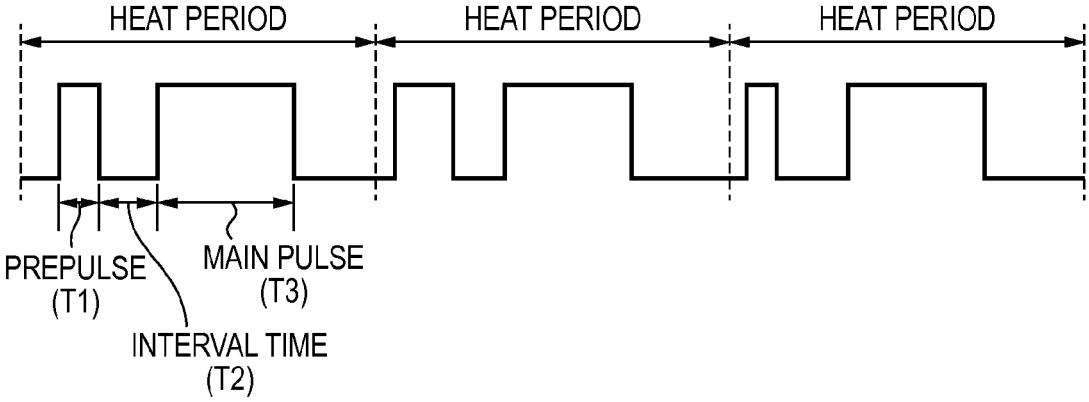
FIG. 22 is a timing chart showing the structure of a double-pulse.
Figures 23A, 23B:
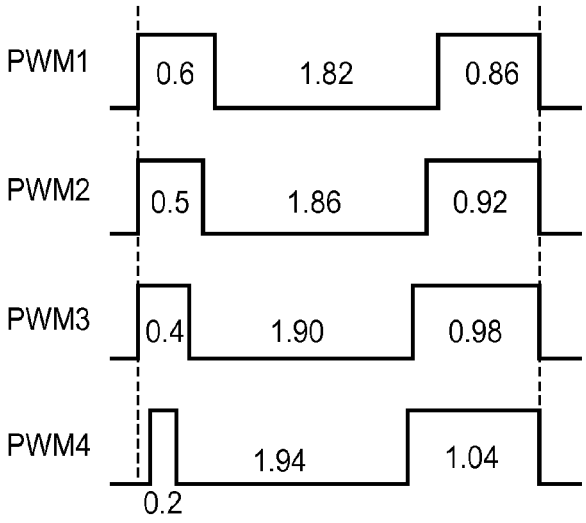
FIGS. 23A and 23B are views showing an example in which the respective times of a double-pulse are adjusted in accordance with the environmental temperature based on an arrangement disclosed in Japanese Patent Laid-Open No. 2008-302691.

That is, a double-pulse HE signal including a prepulse, an interval time, and a main pulse in one heat period, as shown in FIG. 22, is used. In addition, the total time of the double-pulse including a prepulse T1, an interval time T2, and a main pulse T3 is fixed (that is, T1+T2+T3 is a predetermined value), like PWM1 to PWM4 disclosed in Japanese Patent Laid-Open No. 2008-302691 as shown in FIGS. 23A and 23B. For example, in PWM4, the rise of the prepulse delays slightly as compared to PWM1 to PWM3. However, the fall of the main pulse is fixed to align the discharge timing.

Assuming the above-described arrangement, a method of generating a double-pulse HE signal based on one reference voltage will be described next. A method of generating a double-pulse by controlling the pulse width of the HE signal for each heater (print element) in accordance with fluctuations in the element substrate (for example, temperature distribution, fluctuation in heater resistance, and film thickness distribution of a protection film) will be explained here. Although a stepwise wave is generated in fact using a DAC, a ramp wave having a predetermined slope is used here for the sake of descriptive simplicity.

Figure 6A:
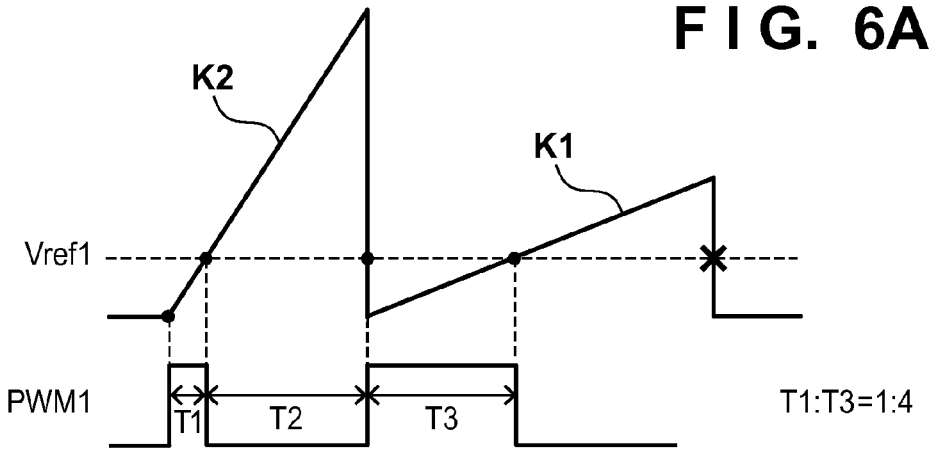
FIGS. 6A, 6B, and 6C are timing charts showing states in which a double-pulse heat enable (HE) signal is generated according to the first embodiment.
Figure 6B:
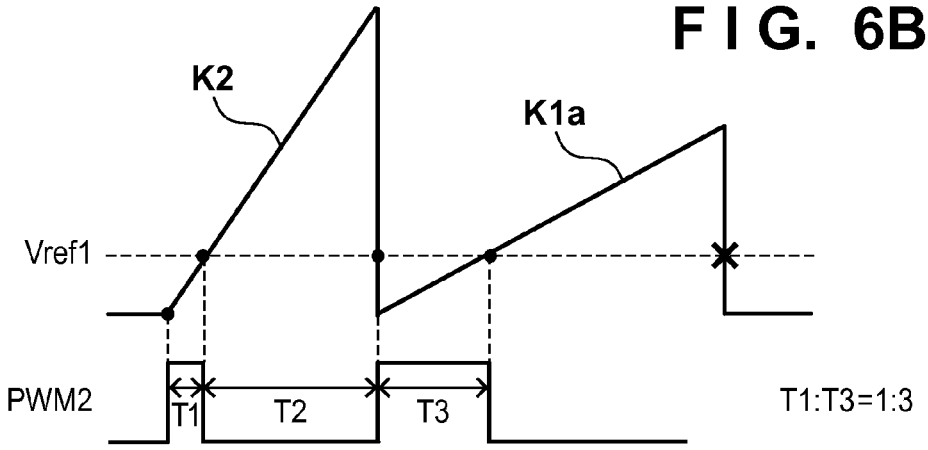
Figure 6C:
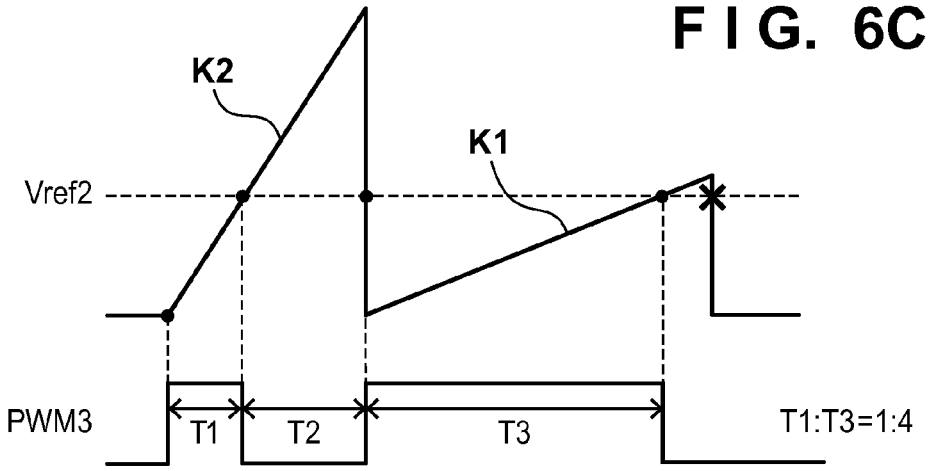

FIGS. 6A to 6C are timing charts showing states in which a double-pulse heat enable (HE) signal is generated according to this embodiment.

FIG. 6A shows a case where the ratio of the prepulse width T1 to the main pulse width T3 is set to 1:4. When the reference voltage is Vref1, and a slope K1 of the ramp wave for the main pulse is used as a reference, a ramp wave having a four-times larger slope K2 is input to form the prepulse width. The absolute value of the time of the pulse is determined by the reference voltage Vref1. The time from the time at which the ramp wave having the slope K2 exceeds the reference voltage to the fall timing of the ramp wave having the slope K2 is the interval time T2. In this embodiment, the fall timing of the ramp wave having the slope K2 is made to match the start timing of the main pulse. The switch 209 of the comparator is turned off from the end of the ramp wave for the main pulse to input of the next ramp wave. Note that the comparator is also called a comparison circuit.

FIG. 6B shows a case where the ratio of the prepulse width T1 to the main pulse width T3 is set to 1:3. The reference voltage is Vref1, and the slope of the ramp wave for the main pulse is set to K1a while maintaining the slope K2 of the ramp wave for the prepulse. The slope K1a is ⅓ the slope K2. This makes it possible to shorten the pulse width of the main pulse while keeping the prepulse width T1 and the interval time T2 constant.

FIG. 6C shows a case where the absolute values of the prepulse width T1 and the main pulse width T3 are made large while keeping the ratio of the prepulse width T1 to the main pulse width T3 at 1:4. In this case, the reference voltage is set to Vref2 that is higher than Vref1. The slope of the ramp wave for the main pulse is set to K1. The slope of the ramp wave for the prepulse is set to K2.

In this way, any desired double-pulse can be generated by changing the slope of the ramp wave with respect to one set reference voltage Vref or changing the reference voltage Vref without changing the slope of the ramp wave. Note that giving a supplementary explanation, input of the ramp wave for the prepulse is done next to input of the reference voltage (to be described later).

A method of individually adjusting the pulse width for each heater will be described here.

Figure 7:
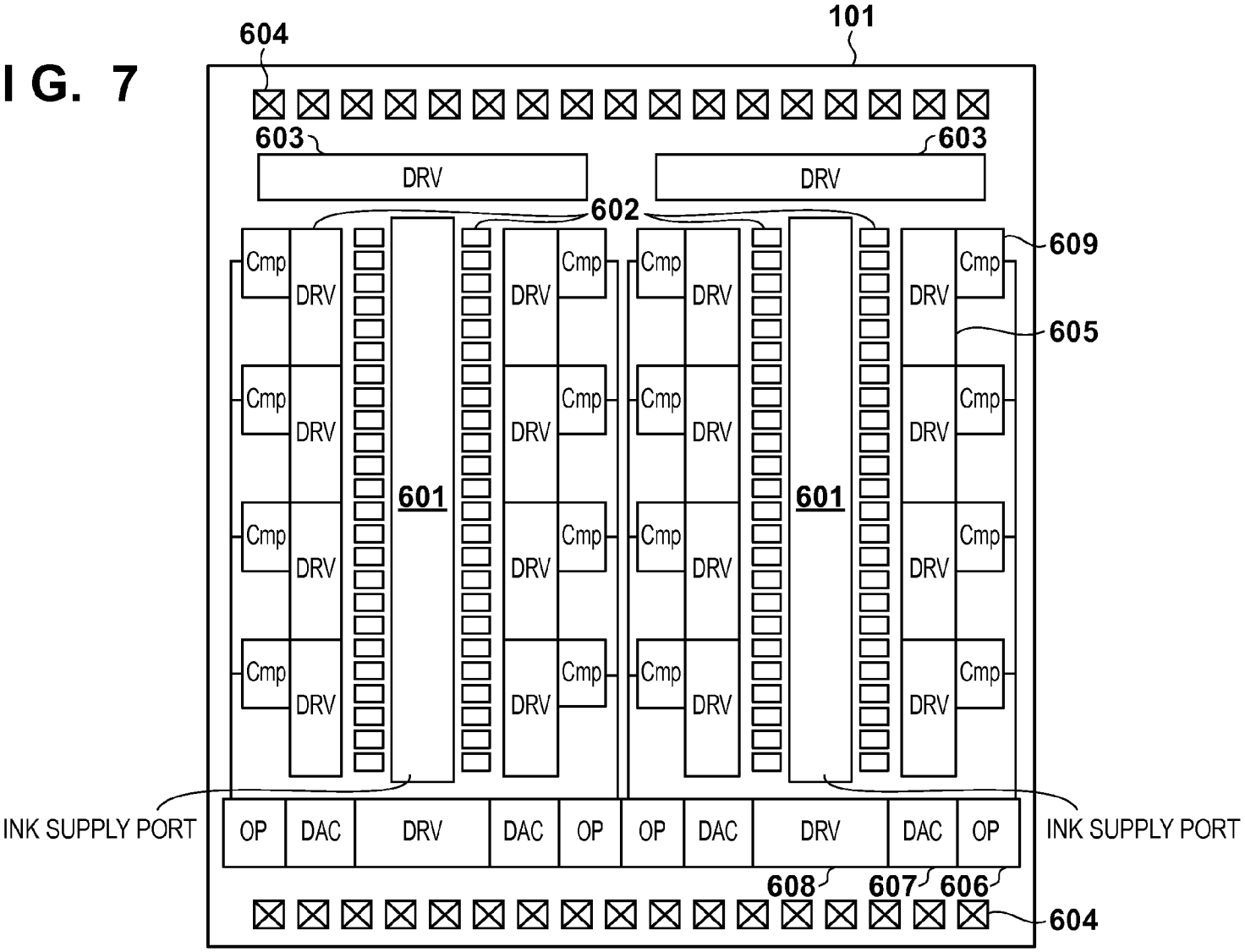
FIG. 7 is a view schematically showing the layout of the element substrate of the printhead.

FIG. 7 is a view schematically showing the layout of the element substrate of the printhead.

In the example shown in FIG. 7, two ink supply ports 601 are formed in the element substrate 101. A circuit block corresponding to each ink supply port includes heaters 602 that are arranged in arrays at opposing positions sandwiching the ink supply port. Driving circuits (DRV) 605 configured to selectively drive the heaters of the heater arrays are arranged in correspondence with the heaters 602. Pads 604 configured to perform power supply and signal application to the heaters and the driving circuits are arranged at the upper and lower ends of the element substrate 101.

Driving circuits (DRV) 603 are arranged between the pads 604 along the upper side of the element substrate 101 and the ink supply ports 601 and the heater arrays. Comparators (Cmp) 609 are arranged near the driving circuits (DRV) 605 provided behind the heaters 602.

On the other hand, OP amplifiers (OP) 606 and DACs (Digital/Analog Converters) 607 are arranged between the pads 604 along the lower side of the element substrate 101 and the ink supply ports 601 and the heater arrays. Such a circuit layout makes it possible to individually set the pulse width of the HE signal for each heater and give adequate energy to each heater.

Figure 8:
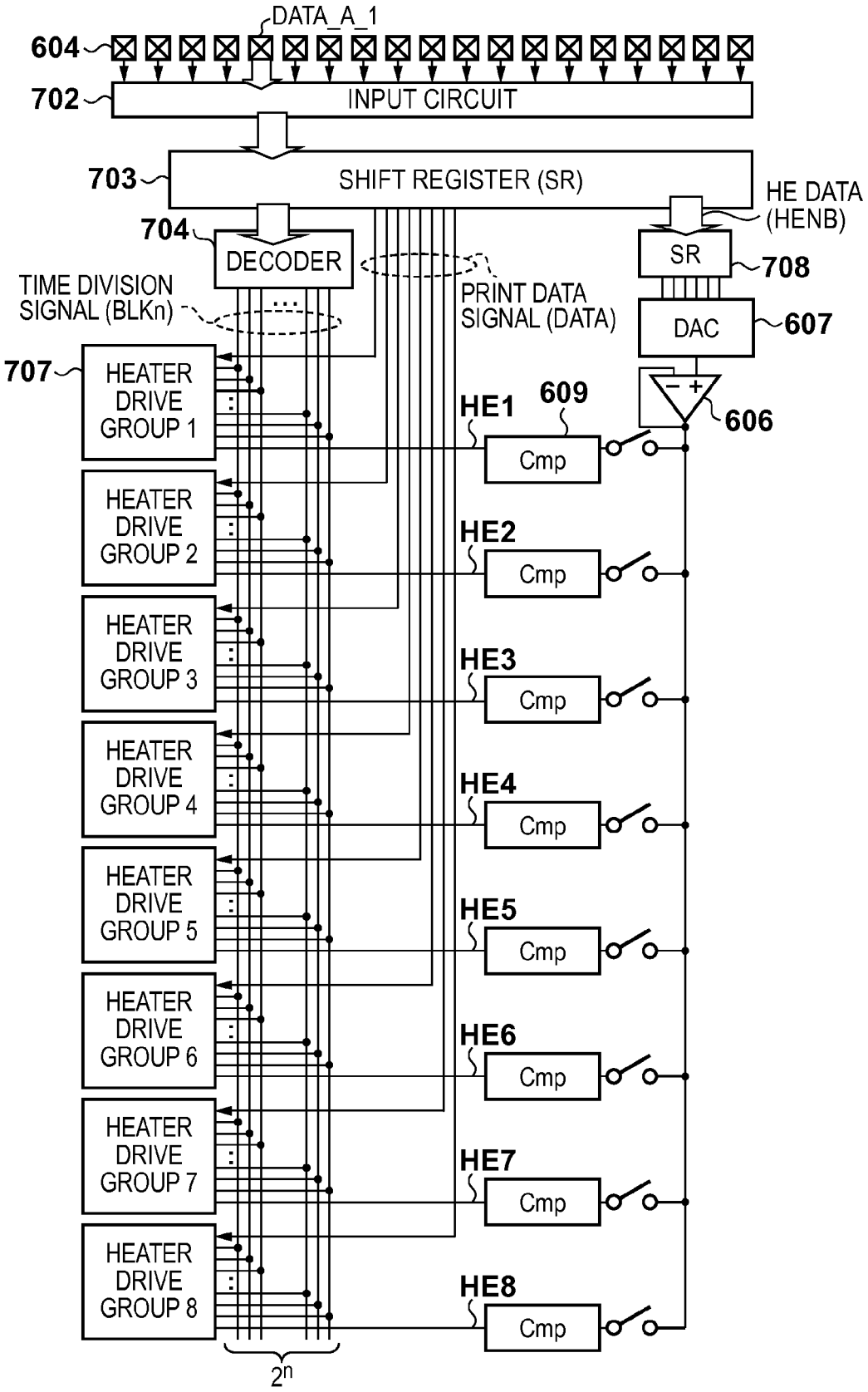
FIG. 8 is a block diagram schematically showing the flow of signals and details of part of the circuit arrangement of the circuit layout shown in FIG. 7.

FIG. 8 is a block diagram schematically showing the flow of signals and details of part of the circuit arrangement of the circuit layout shown in FIG. 7.

A data signal DATA_A__1 applied to the pad 604 includes a clock signal CLK, a latch signal LT, and print data signal DATA, and is input to a shift register (SR) 703 and a decoder 704 included in the internal circuit, via an input circuit 702. The print data signal DATA selects heaters to be driven during a certain heat period.

As the data signal, another signal is input from a pad that changes depending on the circuit block. The input data signal is expanded by the shift register 703, and some of the signals are input to a plurality of heater drive groups 707 as the print data signals DATA to select enable/disable of the heater drive groups. Some of the remaining signals of the expanded data signals are input to the decoder 704. The decoder 704 outputs time division signals (BLKn) 706 that sequentially switch over heaters to be driven in the heater drive groups. Provided that one group includes $2^n$ heaters, $2^n$ time division signals are necessary.

In this case, one heater drive group includes $2^n$ heaters continuously provided on the element substrate while being close to each other in a heater array. The $2^n$ heaters are time-divisionally driven. One comparator (comparison circuit) is provided in correspondence with each group.

HE data (HENB) included in still another part of the remaining signals of the data signals are supplied to the comparators (Cmp) 609 via a DAC shift register (SR) 708, the DAC 607, and the OP amplifier (OP) 606. Each comparator (Cmp) 609 generates a heat enable (HEn) signal. In the example of FIG. 8, eight HE signals HE1 to HE8 are generated.

The DAC 607 is a circuit (generation circuit) capable of generating an analog voltage value set by digital data. In this embodiment, using the capability of generating any desired voltage value, the DAC 607 is used to generate the reference voltage Ref and the ramp wave. The shift register (SR) 708 receives the HE data (HENB) for determining the HE pulse width, which is included in the data signal, from the shift register (SR) 703 and transfers the HE data to the DAC 607. The comparators (Cmp) 609 of the plurality of groups are connected to the DAC 607 via the OP amplifier 606.

The comparators (Cmp) 609 function as the load of the DAC 607. Hence, if directly connected, the response speed decreases, and the output waveform is rounded. On the other hand, the OP amplifier 606 operates so to make the input and output equal upon receiving negative feedback. Using this characteristic, the OP amplifier 606 is inserted between the DAC 607 and the comparators 609. Since the load of the DAC 607 includes only the OP amplifier 606, the same waveform as the output of the DAC 607 can be output to the comparators 609. In this way, the reference voltage and the ramp wave are generated by the DAC 607 and transferred to the comparators 609.

Figure 9A:
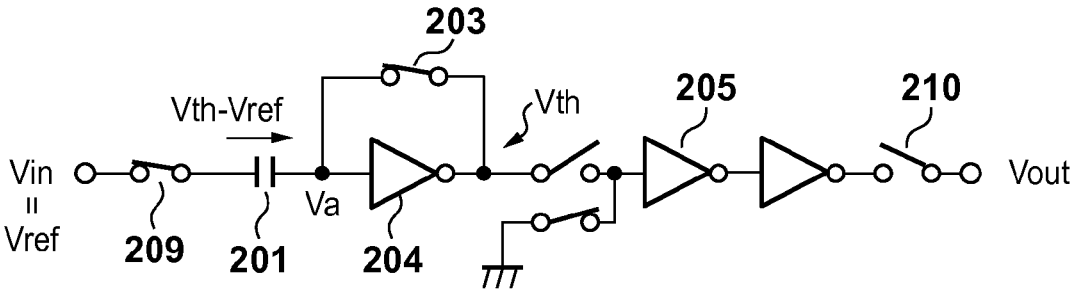
FIGS. 9A, 9B, and 9C are views for explaining the operation of a comparator 609.
Figure 9B:
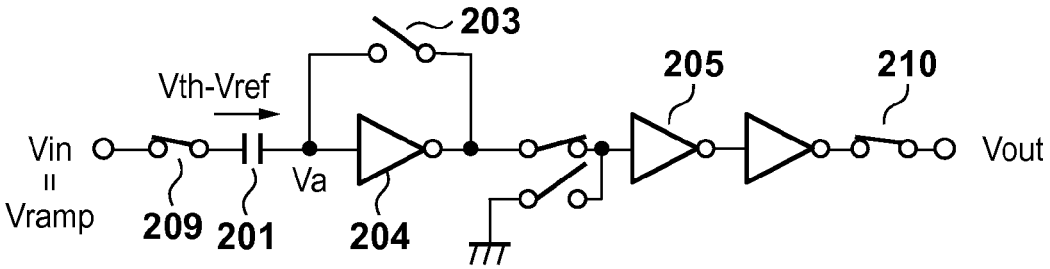
Figure 9C:
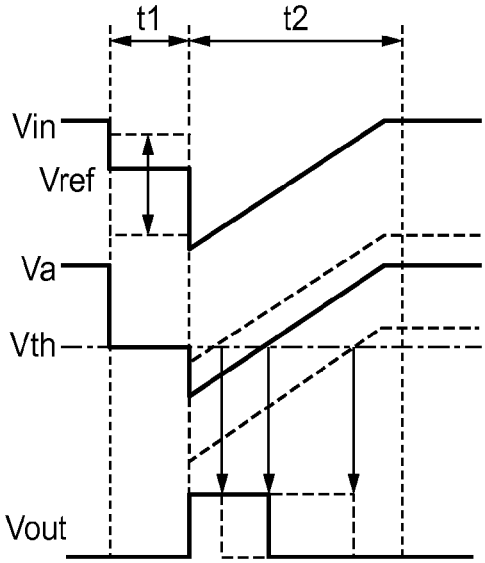

FIGS. 9A to 9C are views for explaining the operation of the comparator 609.

The circuit arrangement of the comparator 609 shown in FIGS. 9A to 9C is the same as that described with reference to FIG. 21. The same reference numerals denote the same parts, and the description thereof will be omitted. FIG. 9A shows a state in which the switch 203 is closed, and FIG. 9B shows a state in which the switch 203 is open. The operation of the comparator 609 will be described next with reference to FIG. 9C. FIG. 9C shows time-rate changes in an input voltage Vin of the comparator 609, an input voltage Va of the inverter 204, and an output voltage Vout of the comparator 609.

During a period t1, the switches 203 and 209 are closed. When the switch 203 is closed, the input and output of the inverter 204 short, and the potential Va of the electrode of the capacitor 201 on the side of the inverter 204 changes to Vth. Vth is the threshold voltage of the inverter 204. When the switch 209 is closed, the potential of the electrode of the capacitor 201 on the side of the switch 209 changes to Vref.

The capacitor 201 is thus electrically charged in proportion to Vth−Vref (in other words, a potential difference Vth−Vref is applied to the capacitor 201).

During a period t2, the switch 203 is opened. The potential difference Vth−Vref is maintained across the capacitor 201 serving as a memory. The switch 209 is closed (FIG. 9B), and a ramp wave Vramp (FIG. 9B) is input as Vin. When the ramp wave Vramp is input, Va=Vref−Vth+Vramp. Since the potential of the input ramp wave Vramp is set to be lower than the potential Vref in the initial state, Va becomes lower than the threshold voltage Vth of the inverter 204. For this reason, the inverter 204 outputs H level. Accordingly, Vout rises. The potential of the ramp wave Vramp gradually rises as the time elapses. During the time when the potential of the ramp wave Vramp is lower than the potential Vref, the inverter 204 outputs H level. When the potential of the ramp wave Vramp exceeds the potential Vref, the potential Va becomes higher than Vth, and the inverter 204 outputs L level. Accordingly, Vout falls. In the above-described way, a pulse is output from Vout, as shown in FIG. 9C.

As described above, the comparator adjusts the pulse width by the reference voltage Vref that charges the capacitor serving as a memory and the ramp wave. The comparator according to this embodiment includes a capacitor serving as the memory portion and an inverter in the comparison portion, as described above. Hence, the comparator has a small circuit scale and is therefore advantageous for suppressing the substrate area.

The DAC 607 will be described next.

Figure 10:
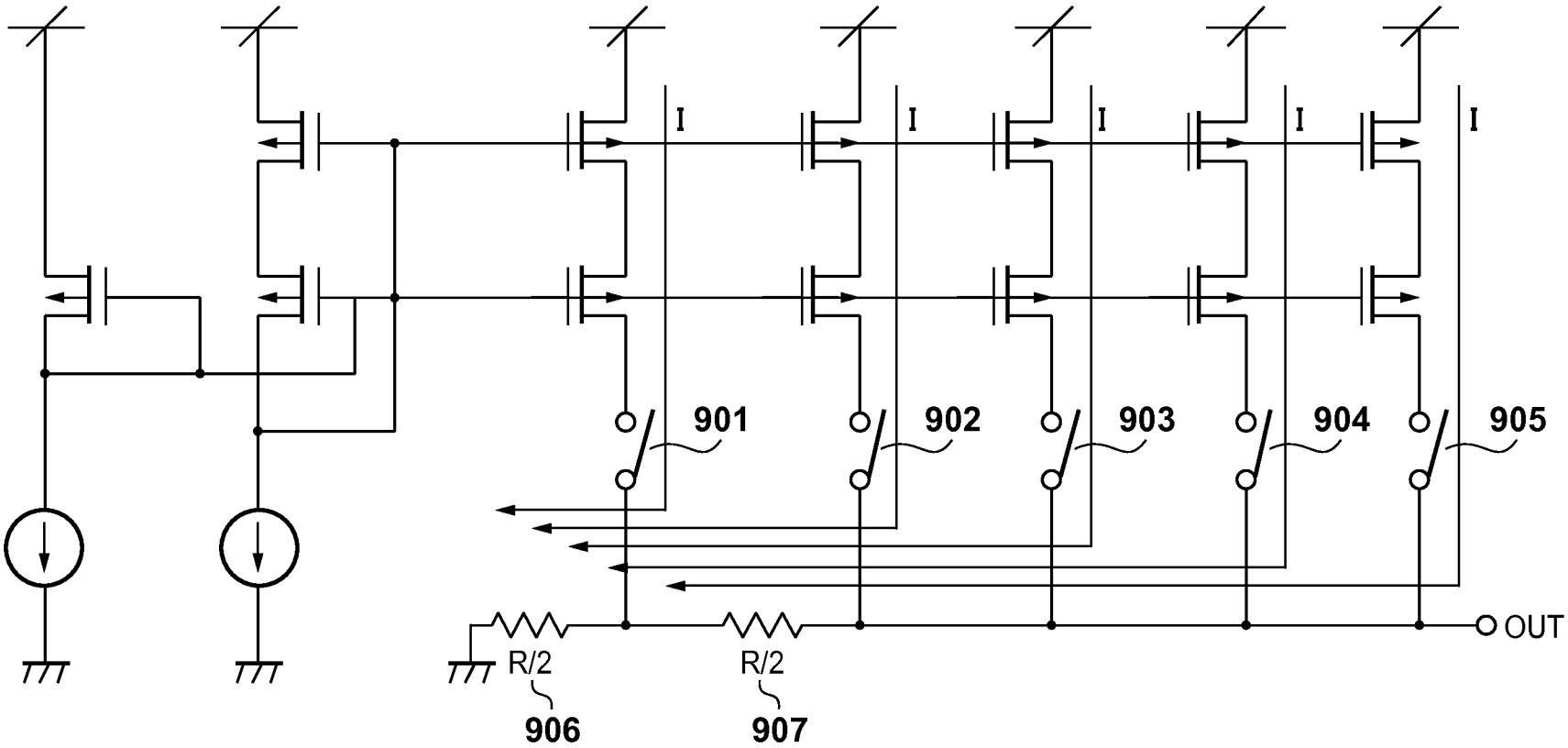
FIG. 10 is a circuit diagram showing the arrangement of a DAC 607 that generates a ramp wave and a reference voltage Vref.

FIG. 10 is a circuit diagram showing the arrangement of the DAC 607 that generates the ramp wave and the reference voltage Vref. FIG. 10 illustrates an example of the arrangement of a 4-bit DAC. Reference numerals 901 to 905 denote switches configured to turn on/off the bits; and 906 and 907, resistors configured to convert a current into a voltage.

Using an arrangement that parallel-connects a plurality of current mirror circuits, the DAC 607 controls the switches 901 to 905 provided in the output portions of the current mirror circuits and adjusts a current flowing to the resistors, thereby generating any desired voltage. In this arrangement, the outputs from the switches 902 to 905 correspond to the four bits, respectively.

When the switch 902 is turned on, a current I flows. Hence, a voltage (R/2+R/2)×I=RI is output from an output terminal OUT. When the switch 903 is further turned on, 2×RI is output. When the switch 904 is turned on, 3×RI is output. When the switch 905 is turned on, 4×RI is output. When the switches are turned on/off in this way, any desired voltage can be generated.

In this embodiment, the reference voltage Vref and the ramp wave are generated by a common DAC. Hence, the ramp wave and the reference voltage Vref shifted by a ½ level need to be generated by one DAC. For this reason, the DAC 607 is configured such that a resistor R is divided into the resistors 906 and 907 each corresponding to R/2, and a current controlled by the switch 901 flows between them. Hence, such an arrangement need not be employed when the DAC is not shared. Another arrangement that, for example, adds a weight to the current by the size ratio of MOS transistors may be employed.

Figure 11:
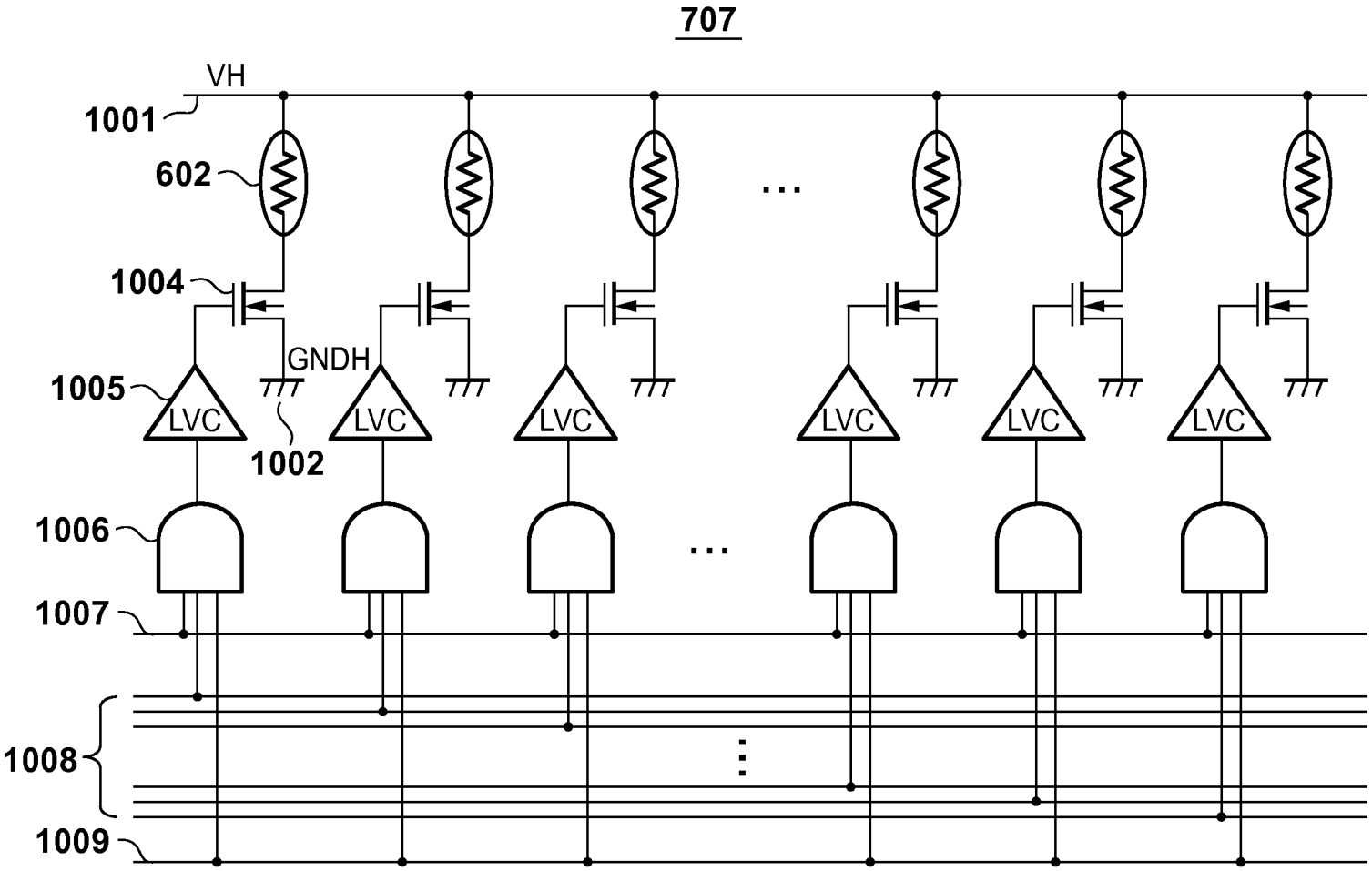
FIG. 11 is a circuit diagram showing the internal arrangement of a heater drive group 707.

FIG. 11 is a circuit diagram showing the internal arrangement of the heater drive group 707.

Note that as is apparent from FIG. 8, a plurality of heater drive groups each having the same arrangement as that shown in FIG. 11 are integrated on the element substrate 101.

The heater drive group 707 is formed from drive elements 1004, voltage conversion circuits (LVC) 1005, and heater selection circuits 1006, which are arranged in correspondence with the heaters 602 arranged in an array. An externally supplied heater power supply voltage (VH: first power supply voltage) is applied to a heater power supply line 1001. A current flows to ground (GNDH) 1002 via the heaters 602.

The drive element 1004 serves as a switching element for determining whether or not to send an electric current to the heater 602. Signals from a print data signal line 1007, a time division signal line 1008, and a heat enable signal line 1009 are input to an AND gate that is the heater selection circuit 1006. When all the three signals are active, the output of the AND gate is active. The voltage conversion circuit 1005 level-converts (boosts) the voltage swing of the output signal of the AND gate to a power supply voltage (VHM: second power supply voltage) higher than the driving voltage (VDD: third power supply voltage) used for driving the input circuit 702 to the heater selection circuit 1006. The level-converted signal is applied to the gate of the drive element 1004. The heater 602 connected to the MOS transistor to which the gate voltage is applied is energized and driven.

With such an the arrangement for performing individual control on a heater basis, the reference voltage Vref and the ramp wave shown in FIGS. 6A to 6C are input, and a double-pulse is generated.

In the example shown in FIG. 8, first, the reference voltages Vref for the eight heater drive groups 707 are generated by the DAC 607 and sequentially stored in the memories of the comparators 609 while switching over the switches. After the reference voltages Vref are stored in the comparators of all groups, the ramp wave is input to all groups at the same time. When the ramp wave is input at the same time, the comparators 609 compare the ramp wave and the reference voltages Vref at the same timing, and HE signal pulses corresponding to the reference voltages Vref set in the respective groups are generated.

In this embodiment, a double-pulse is generated. Hence, as shown in FIGS. 6A to 6C, a double-pulse is input every time the ramp wave is input twice.

Three methods of changing the slope of the ramp wave will be described next.

(1) First Method (Method of Switching Over Resistors in DAC)

Figure 12:
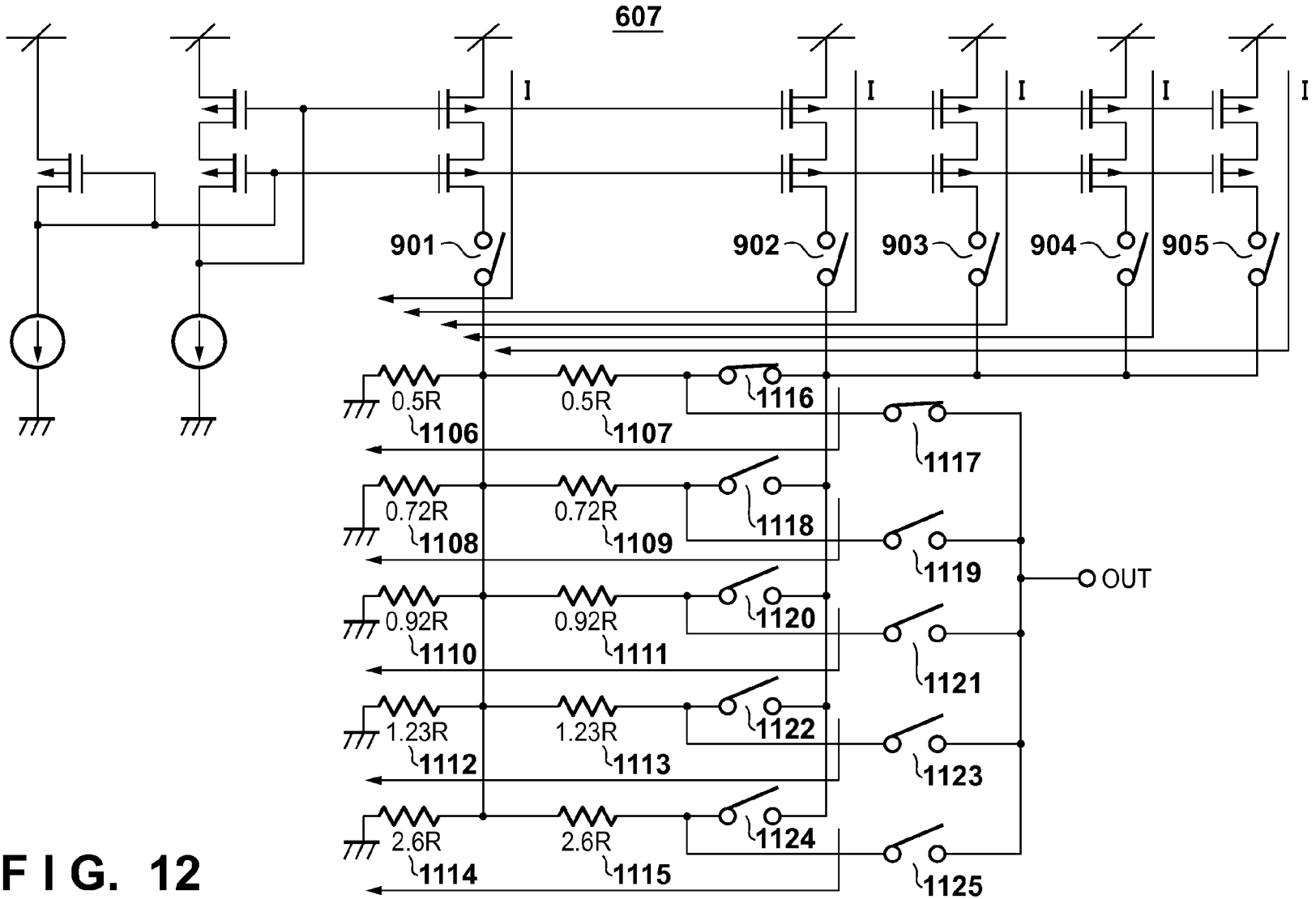
FIG. 12 is a circuit diagram of the DAC 607 having an arrangement for switching over resistors.

FIG. 12 is a circuit diagram of the DAC 607 having an arrangement for switching over the resistors.

The arrangement for generating a current by current mirror circuits is the same as in FIG. 10. The same reference numerals as in FIG. 10 denote the same constituent elements in FIG. 12, and a description thereof will be omitted. In this arrangement, the resistance values of the resistors 906 and 907 shown in FIG. 10 can be selected by turning on/off switches 1116 to 1125. A voltage corresponding to current I×resistance value is output to the output terminal OUT.

Hence, the slope of the ramp wave can be changed by switching over the resistance value. For example, when the switches 1116 and 1117 are turned on, and the switches 902 to 905 are sequentially turned on, voltages 3R×I, 3R×2I, 3R×3I, and 3R×4I are sequentially output, and a ramp wave is generated. Next, when the switches 1118 and 1119 are turned on, voltages 2.1R×I, 2.1R×2I, 2.1R×3I, and 2.1R×4I are sequentially output, and the voltage of the entire ramp wave is compressed. Since the switches 902 to 905 are turned on in accordance with the clock signal CLK, and therefore, the boosting time does not change, the slope of the ramp wave changes. The slope of the ramp wave can be changed by switching over the resistors in this way. The driving pulses PWM1 to PWM4 shown in FIGS. 23A and 23B can be generated by setting the resistance ratio shown in FIG. 12.

(2) Second Method (Method of Switching Over Mirror Ratio of DAC)

Figure 13:
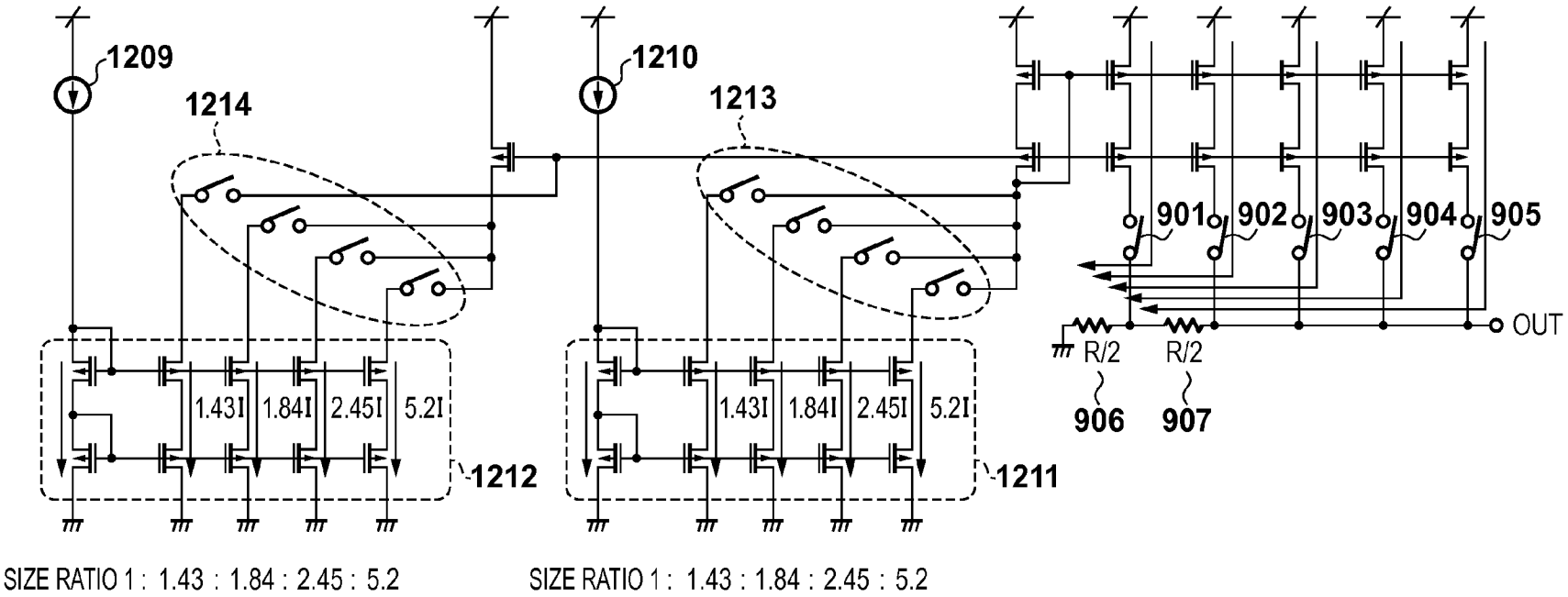
FIG. 13 is a circuit diagram of the DAC 607 having an arrangement for switching over a current mirror ratio.

FIG. 13 is a circuit diagram of the DAC 607 having an arrangement for switching over a current mirror ratio.

The arrangement for generating a current by current mirror circuits is the same as in FIG. 10. The same reference numerals as in FIG. 10 denote the same constituent elements in FIG. 13, and a description thereof will be omitted. In this arrangement, current mirror configurations 1211 and 1212 are employed in the portions of current sources 1209 and 1210. MOS transistors are given a size ratio and selected by switches 1213 and 1214, thereby changing the current value flowing to the switches 902 to 905.

A voltage corresponding to R×current value is output from the output terminal OUT. Hence, for example, when MOSFETs having a size ratio of 3 in the current mirror portions 1211 and 1212 are turned on, a current 3I is mirrored. In this case, since the current 3I flows to the switches 902 to 905 as well, voltages R×3I to R×12I are output from the output terminal OUT. As compared to this, when MOSFETs having a size ratio of 2.1 are selected, voltages R×2.1I to R×8.4I are output from the output terminal OUT, and the voltage of the entire ramp wave is compressed. Since the switches 902 to 905 are turned on in accordance with the clock signal CLK, and therefore, the boosting time does not change, the slope of the ramp wave changes. The driving pulses PWM1 to PWM4 shown in FIGS. 23A and 23B can be generated by setting the size ratio shown in FIG. 13.

(3) Third Method (Method of Switching Over Capacitor of Comparator)

Figure 14:
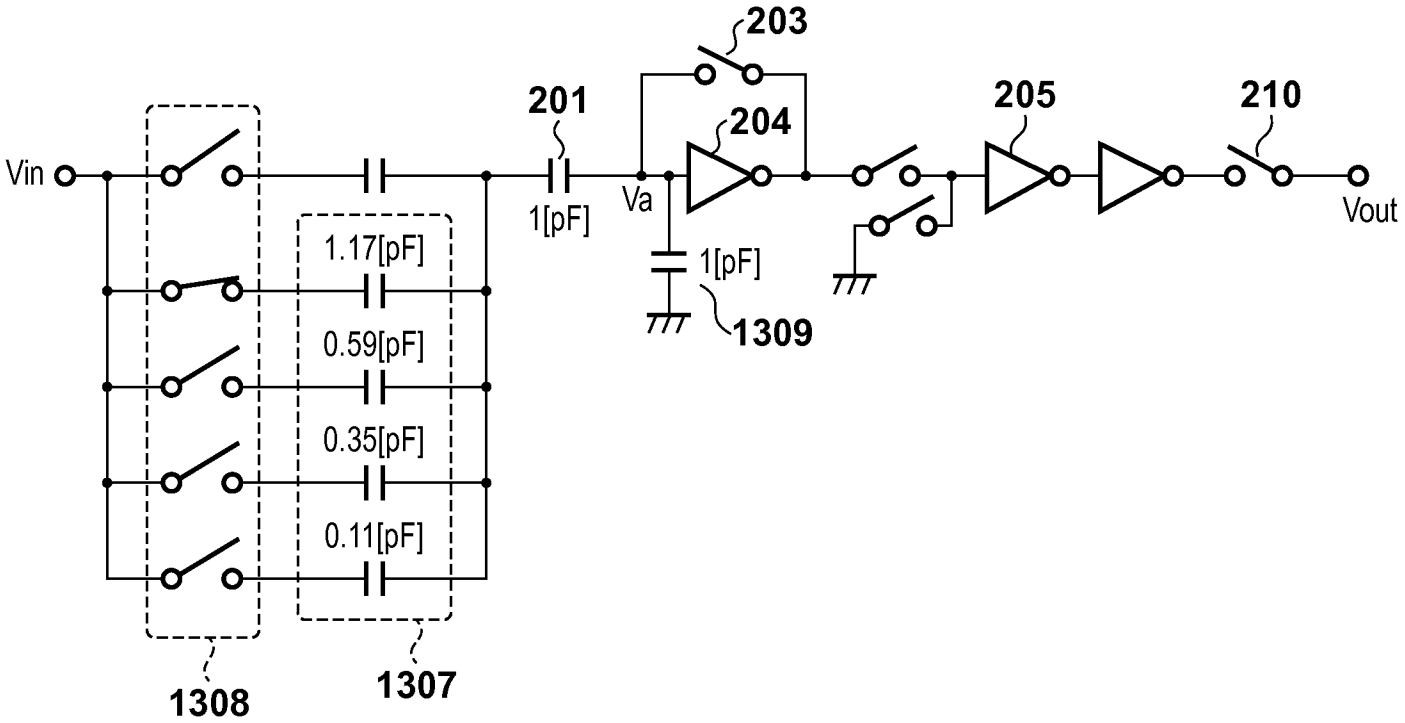
FIG. 14 is a circuit diagram of the comparator 609 having an arrangement for switching over a capacitor.

FIG. 14 is a circuit diagram of the comparator 609 having an arrangement for switching over a capacitor.

Note that the basic arrangement of the comparator is the same as that of the comparator shown in FIG. 21. The same reference numerals as in FIG. 21 denote the same constituent elements in FIG. 14, and a description thereof will be omitted. In this arrangement, the reference voltage Vref input to Vin is stored in the memory (first capacitor) 201 in a state in which the switch 203 is on. After that, the switch 203 is switched over to off, and the ramp wave is input. At the timing where Vramp=reference voltage Vref, the output of the inverter 204 is inverted.

Additionally, in this embodiment, a voltage changeable memory 1307, that is, new capacitors are inserted in series with the capacitor serving as the memory 201. Furthermore, a GND capacitance 1309 is inserted for the descriptive convenience. In this arrangement, the input voltage Va to the inverter 204 has a value obtained by dividing the input voltage Vin by the voltage changeable memory 1307, the memory 201, and the GND capacitance 1309.

For example, in a case where the memory 201 and the GND capacitance 1309 have a capacitance of 1 pF, as shown in FIG. 14, and the driving pulses PWM1 to PWM4 shown in FIGS. 23A and 23B are to be generated, the voltage changeable memory 1307 is sequentially switched over to 1.17 pF, 0.59 pF, 0.35 pF, and 0.11 pF. When Vin=1 [V], and the switch without the voltage changeable memory 1307 is selected, Va=0.5 [V]. When the capacitor having a capacitance of 1.17 pF in the voltage changeable memory 1307 is selected, Va=0.35 [V], and the voltage Va is compressed. Hence, when the ramp wave is input to Vin, the slope of the ramp wave changes at Va.

As described above, in a case where a voltage changeable memory is formed using a plurality of capacitors (second capacitors) whose capacitance values are different from each other, and a capacitor is selected by a switch 1308, the slope of the ramp wave can be selected. In the method of inserting capacitors, the capacitors are inserted in series with the memory 201. Hence, the combined capacitance decreases, and the slope of the ramp wave becomes small. In this adjustment method using the capacitors, the adjustment is made in a direction in which the slope becomes small. Hence, a capacitance ratio assuming a case where the slope of the ramp wave for the main pulse is changed using the prepulse width T1 as a reference has been described.

Hence, according to the above-described embodiment, a plurality of pulses having different pulse widths can be generated from one reference voltage Vref. As a result, many data need not be used to generate the plurality of pulses. This also obviates the necessity of countermeasure of increasing the data transfer speed or dividing data to be transferred. In addition, since the number of memories need not be increased, an increase in the circuit scale can be prevented.

Second Embodiment

An example in which a double-pulse is generated using a ramp wave different from that shown in the first embodiment will be described.

Figure 15A:
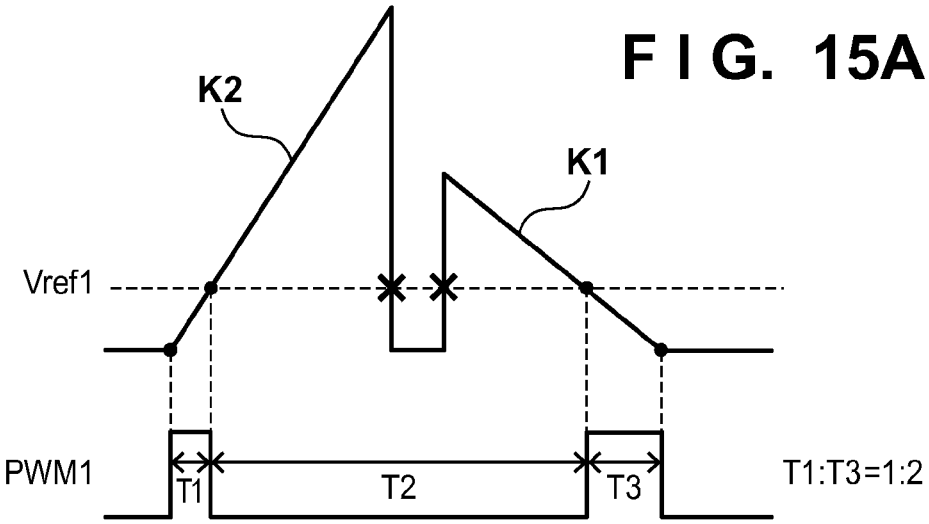
FIGS. 15A, 15B, and 15C are timing charts showing states in which a double-pulse heat enable (HE) signal is generated according to the second embodiment.
Figure 15B:
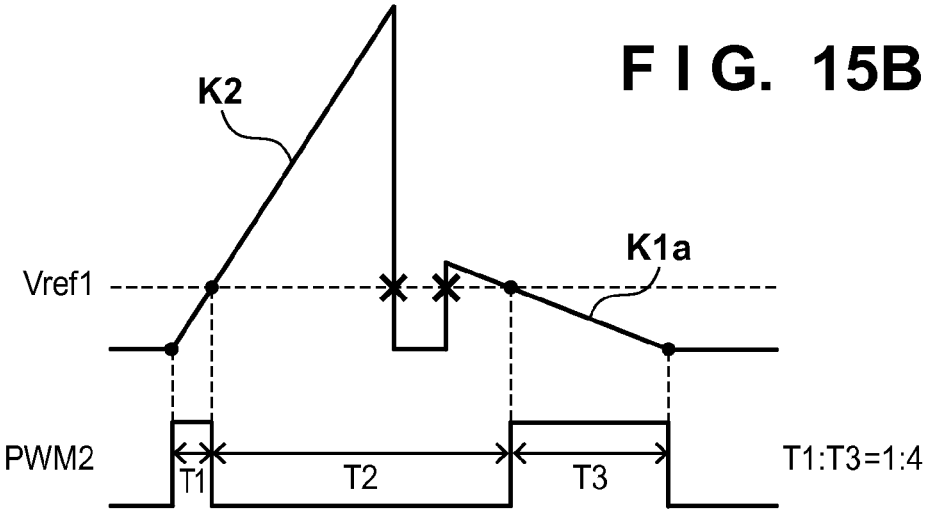
Figure 15C:
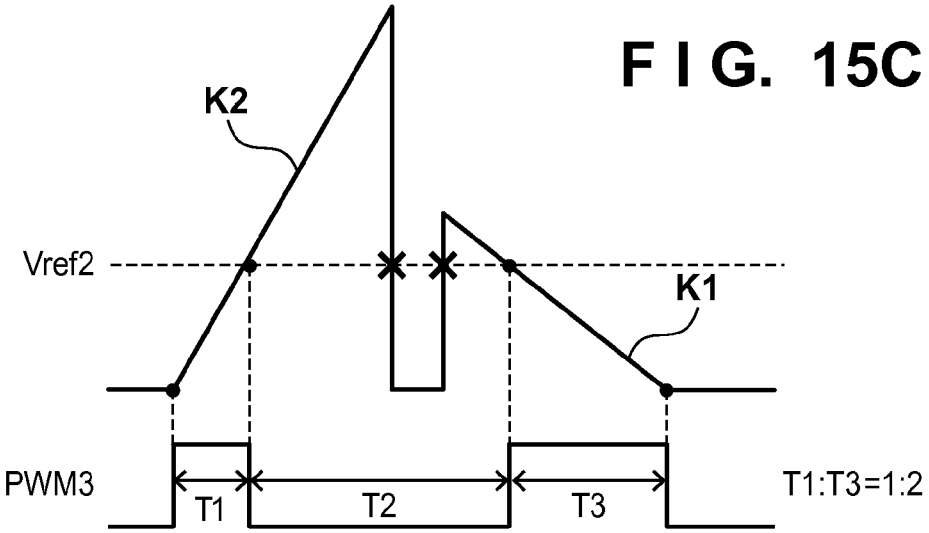

FIGS. 15A to 15C are timing charts showing states in which a double-pulse heat enable (HE) signal is generated according to this embodiment. The voltage value of a ramp wave for a prepulse increases at a predetermined rate along with the elapse of time. The voltage value of a ramp wave for a main pulse decreases at a predetermined rate along with the elapse of time. In this embodiment, the waveform of the ramp wave for the main pulse is inverted from that of the ramp wave for the prepulse, as is apparent from comparison between FIGS. 15A to 15C and FIGS. 6A to 6C.

FIG. 15A shows a case where the ratio of a prepulse width T1 to a main pulse width T3 is set to 1:2. In a case where the reference voltage is Vref1, and a slope K1 of the ramp wave for the main pulse is used as a reference, a ramp wave having a twice larger slope K2 is input to form the prepulse width. The absolute value of the time of the pulse is determined by the reference voltage Vref1. The time from the time at which the ramp wave having the slope K2 exceeds the reference voltage to the time at which the ramp wave having the slope K1 falls below the reference voltage is an interval time T2. Giving a supplementary explanation, the time from the start of the ramp wave for the prepulse to the end of the ramp wave for the main pulse determines the time from the start of the prepulse to the end of the main pulse.

FIG. 15B shows a case where the ratio of the prepulse width T1 to the main pulse width T3 is set to 1:4. The reference voltage is Vref1, and the slope of the ramp wave for the main pulse is set to K1a while maintaining the slope K2 of the ramp wave for the prepulse. The slope K1a is ¼ the slope K2. This makes it possible to prolong the pulse width of the main pulse while keeping the time from the start of the prepulse to the end of the main pulse constant.

FIG. 15C shows a case where the absolute values of the prepulse width T1 and the main pulse width T3 are made large while keeping the ratio of the prepulse width T1 to the main pulse width T3 at 1:2. In this case, the reference voltage is set to Vref2 that is higher than Vref1. The slope of the ramp wave for the main pulse is set to K1. The slope of the ramp wave for the prepulse is set to K2.

In this way, when the waveform of the main pulse is inverted, the start time and end time of the double-pulse can be fixed together with the total time of the double-pulse. For this reason, in a case where the total time is fixed, it is only necessary to change the slope of the ramp wave in accordance with the pulse width, resulting in simple control.

However, when the ramp wave for the prepulse falls at the end, and when the ramp wave for the main pulse rises at the start, the voltage crosses the reference voltage Vref, and the comparator outputs a pulse. Hence, at this time, a switch 210 of the comparator needs to be off. Note that giving a supplementary explanation, input of the ramp wave for the prepulse is done next to input of the reference voltage, as described with reference to FIGS. 9A to 9C, as in the first embodiment.

Third Embodiment

In this embodiment, an example in which ramp waves other than the waveform patterns used in the first and second embodiments are used will be described.

Figure 16A:
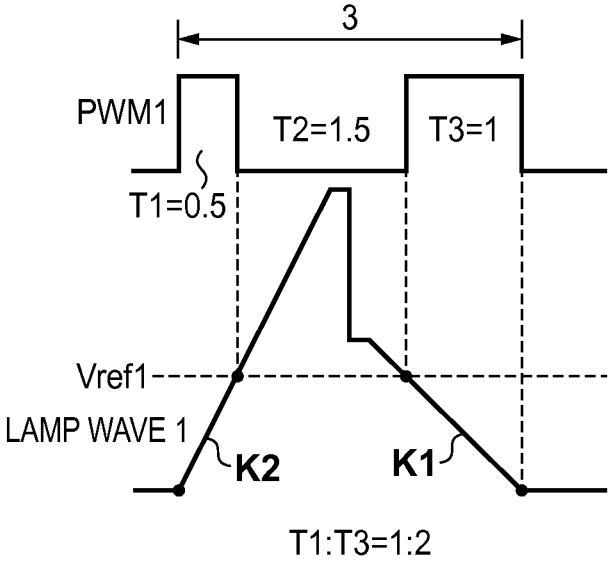
FIGS. 16A and 16B are timing charts showing states in which a double-pulse heat enable (HE) signal is generated according to the third embodiment.
Figure 16B:
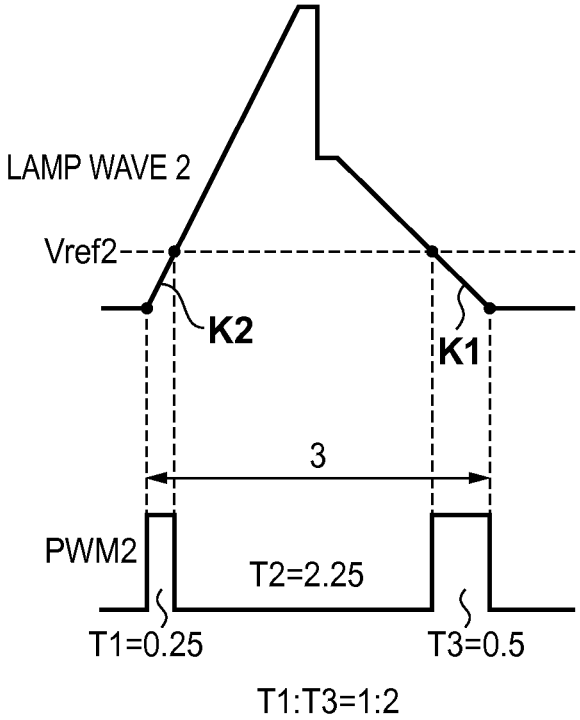

FIGS. 16A and 16B are timing charts showing states in which a double-pulse heat enable (HE) signal is generated according to this embodiment.

This example uses ramp waves in which the waveform of the ramp wave for the main pulse is inverted from that of the ramp wave for the prepulse, and the ramp wave does not fall between the ramp wave for the prepulse and that for the main pulse. FIG. 16A shows an example in which Vref1 is used as the reference voltage, and FIG. 16B shows an example in which Vref2 is used.

This ramp wave can fix the start time and end time together with the total time of the double-pulse, as in the second embodiment. It is therefore possible to change the prepulse width, the interval time, and the main pulse width only by changing the reference voltage Vref.

For example, when the reference voltage Vref1 shown in FIG. 16A is changed to the reference voltage Vref2 shown in FIG. 16B, T1, T2, and T3 change in accordance with the reference voltage Vref while the ratio of T1:T3 remains unchanged, as in the second embodiment. In addition, the ramp wave according to this embodiment does not cross the reference voltage Vref because it does not fall after the end of the ramp wave for the prepulse. Hence, the switch of the comparator need not be turned off, unlike the second embodiment, and the control becomes simpler. The slope of the ramp wave is switched over between the end of the ramp wave for the prepulse and the start of the ramp wave for the main pulse. The switchover timing can be set at any point between them. FIGS. 16A and 16B show an example in which the switchover is done at the midpoint of the double-pulse.

A method of generating driving pulses PWM1 to PWM4 shown in FIGS. 23A and 23B using the ramp wave shown in FIGS. 16A and 16B will be described next.

Figure 17B:
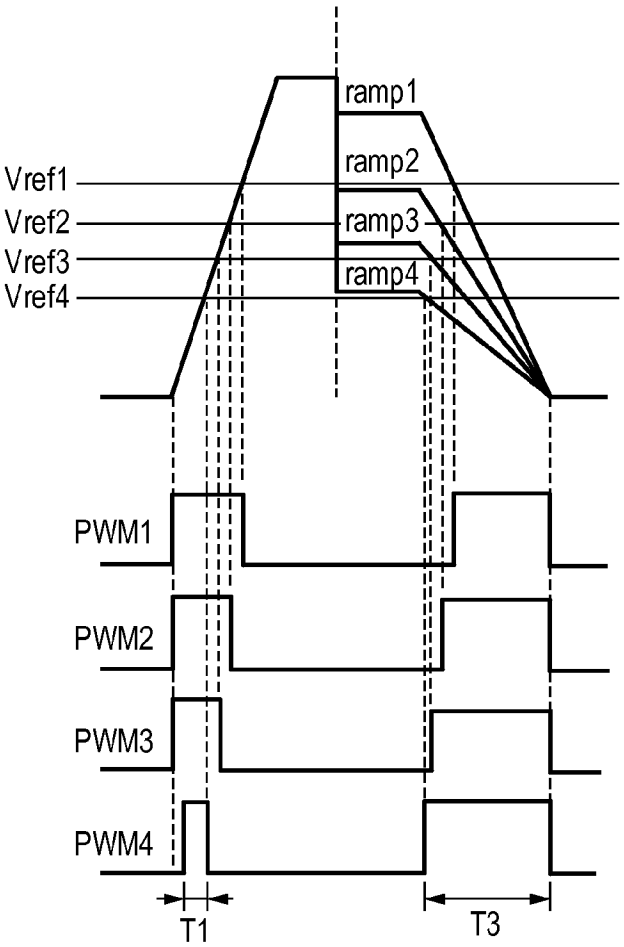
FIGS. 17A and 17B are timing charts showing states in which driving pulses PWM1 to PWM4 are generated according to the third embodiment.
Figure 17A:
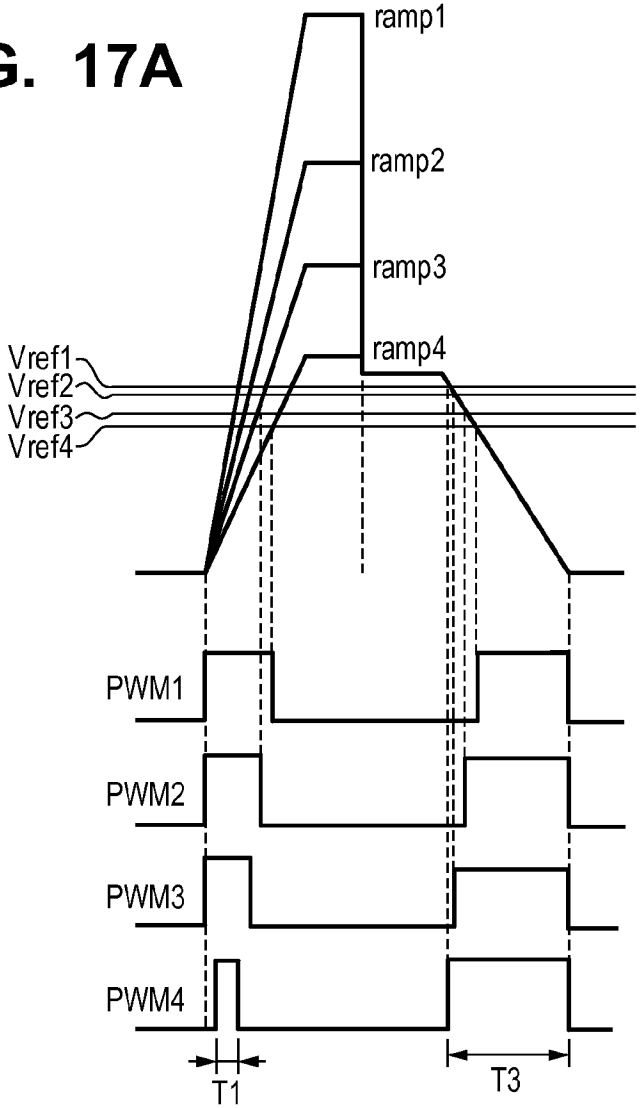

FIGS. 17A and 17B are timing charts showing states in which the driving pulses PWM1 to PWM4 are generated according to this embodiment.

FIG. 17A shows a state in which the driving pulses are generated using the main pulse width as a reference. FIG. 17B shows a state in which the driving pulses are generated using the prepulse width as a reference.

In the example of FIG. 17A, the reference voltages Vref1 to Vref4 are determined using the main pulse width T3 as a reference based on the slope of the ramp wave for the main pulse. When the slope of the ramp wave for the prepulse is changed in accordance with the reference voltage Vref and the prepulse widths T1 of the driving pulses PWM1 to PWM4, the voltage waveform of the ramp wave changes to ramp1 to ramp4.

The slope of the ramp wave for the main pulse may be changed using the prepulse width T1 as a reference, as shown in FIG. 17B. The slopes of both the ramp wave for the prepulse and that for the main pulse may be changed. Note that giving a supplementary explanation, input of the ramp wave for the prepulse is done next to input of the reference voltage, as described with reference to FIGS. 9A to 9C, as in the first and second embodiments.

FIG. 18 is a table showing values that are necessary in a case where three different methods are used to obtain the different driving pulses PWM1 to PWM4 by changing the slope of the ramp wave for the main pulse using the prepulse as a reference.

FIG. 18 shows ratios in (1) method of changing the slope by the resistance ratio of the DAC, (2) method of changing the slope by the mirror ratio of the DAC, and (3) method of changing the slope by the capacitance ratio of the comparator. When the ratios shown in FIG. 18 are used, the driving pulses PWM1 to PWM4 shown in FIGS. 23A and 23B can be generated.

Figure 19:
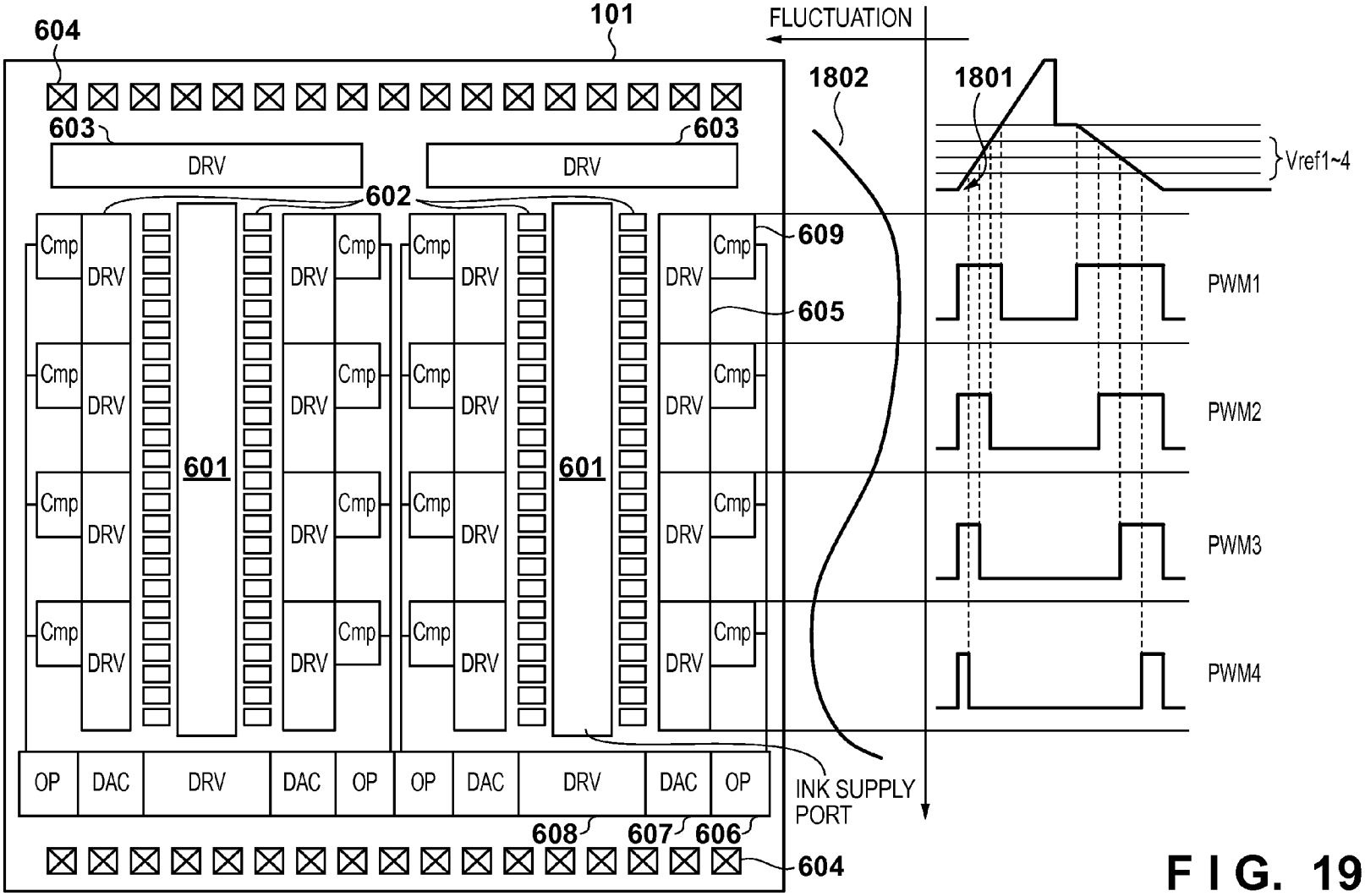
FIG. 19 is a view showing a change in driving pulses applied in a case where there exists a fluctuation in the film thickness, resistance, or the like in the heater array direction on the element substrate.

FIG. 19 is a view showing a change in driving pulses applied when there exists a fluctuation in the film thickness, resistance, or the like in the heater array direction on the element substrate. The circuit layout shown on the left side of FIG. 19 is the same as that shown in FIG. 7.

When the element substrate has a fluctuation 1802 in the film thickness, resistance, or the like in the arrayed direction of heaters 602, as shown in the middle of FIG. 19, for example, a ramp wave having a slope 1801 is input commonly for the heater arrays, and the reference voltages Vref1 to Vref4 are set for each heater drive group, as shown on the right side of FIG. 19. With this arrangement, the driving pulses PWM1 to PWM4 are generated.

Hence, according to the above-described embodiment, a plurality of pulses having different pulse widths can be generated only by setting one reference voltage and switching over the slope of the ramp wave. In addition, since the ramp wave does not cross the reference voltage, control to switch over the switch of the comparator is unnecessary, and the control becomes simpler.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-138440, filed Jul. 1, 2013, which is hereby incorporated by reference herein in its entirety.

What is claimed is:

1. An element substrate comprising:

a plurality of print elements;

a plurality of drive elements provided in correspondence with said plurality of print elements and configured to drive said plurality of print elements; and a driving circuit configured to generate a double-pulse upon receiving a single reference voltage and two ramp waves and apply the double-pulse to said plurality of drive elements and drive said plurality of drive elements, wherein said driving circuit includes:

a generation circuit configured to generate the single reference voltage and the two ramp waves; and a comparison circuit configured to compare the single reference voltage with the two ramp waves, and said driving circuit generates a plurality of double-pulses having different pulse widths from a result of comparison of said comparison circuit, using ramp waves having different slopes.

2. The element substrate according to claim 1, wherein the double-pulse is formed from a prepulse, an interval time, and a main pulse, and a total time of a width of the prepulse, the interval time, and a width of the main pulse is constant in the plurality of double-pulses.

3. The element substrate according to claim 2, wherein said generation circuit comprises a digital/analog converter, said digital/analog converter includes:

a plurality of current mirror circuits;

a plurality of switches series-connected to outputs of said plurality of current mirror circuits and configured to turn on/off outputs from said plurality of current mirror circuits, respectively; and an output portion parallel-connected to said plurality of switches and configured to output different voltages by turning on/off said plurality of switches, said output portion includes:

a plurality of resistors whose resistance values are different from each other; and a plurality of switches series-connected to said plurality of resistors, respectively, and said plurality of switches of said output portion are turned on/off to change the slope of at least one of the ramp waves.

4. The element substrate according to claim 2, wherein said generation circuit comprises a digital/analog converter, said digital/analog converter includes:

a plurality of current mirror circuits;

a plurality of switches series-connected to outputs of said plurality of current mirror circuits and configured to turn on/off outputs from said plurality of current mirror circuits, respectively;

an output portion parallel-connected to said plurality of switches and configured to output different voltages by turning on/off said plurality of switches;

a current source configured to supply a current to said plurality of current mirror circuits;

a plurality of other current mirror circuits connected to said current source and having mirror ratios that are different from each other; and a plurality of other switches connected to said plurality of other current mirror circuits, respectively, and said plurality of other switches are turned on/off to change the slope of at least one of the ramp waves.

5. The element substrate according to claim 2, wherein said comparison circuit includes:

a first capacitor configured to store the reference voltage;

a plurality of second capacitors series-connected to said first capacitor and having capacitances that are different from each other; and a plurality of switches series-connected to said plurality of second capacitors, respectively, and said plurality of switches are turned on/off to change the slope of at least one of the ramp waves.

6. The element substrate according to claim 2, wherein said generation circuit generates the two ramp waves such that both the ramp wave used to generate the prepulse and the ramp wave used to generate the main pulse have a waveform that rises along with an elapse of time.

7. The element substrate according to claim 2, wherein said generation circuit generates the two ramp waves such that the ramp wave used to generate the prepulse has a waveform that rises along with an elapse of time, and the ramp wave used to generate the main pulse has a waveform that falls along with the elapse of time.

8. The element substrate according to claim 2, wherein said generation circuit generates the two ramp waves such that no interval is formed between fall of the ramp wave used to generate the prepulse and rise of the ramp wave used to generate the main pulse.

9. The element substrate according to claim 1, wherein said plurality of print elements are divided into a plurality of groups each formed from a plurality of print elements arranged close to each other for time-divisional driving, and each of the plurality of groups includes the comparison circuit.

10. The element substrate according to claim 1, further comprising an ink supply port configured to supply ink to each of said plurality of print elements.

11. A printhead that forms a full-line printhead in which a plurality of element substrates according to claim 1 are arranged in an arrayed direction of the plurality of print elements to obtain a print width corresponding to a width of a printing medium.

12. The printhead according to claim 11, wherein said full-line printhead comprises an inkjet printhead configured to discharge ink and print on the printing medium.

13. A printing apparatus for printing using a printhead according to claim 12.

* * * * *